United States Patent [19]

Hirabayashi et al.

[11] Patent Number: 4,892,807

[45] Date of Patent: Jan. 9, 1990

[54] SILVER HALIDE PHOTOGRAPHIC LIGHT-SENSITIVE MATERIAL EXCELLENT IN TREATMENT STABILITY

[75] Inventors: Shigeto Hirabayashi; Hirokazu Sato; Eiichi Sakamoto, all of Hino, Japan

[73] Assignee: Konishiroku Photo Industry Co., Ltd., Tokyo, Japan

[21] Appl. No.: 79,214

[22] Filed: Jul. 29, 1987

[30] Foreign Application Priority Data

Aug. 1, 1986 [JP] Japan ..... 61-181528

[51] Int. Cl.[4] ..... G03C 7/34; G03C 1/34

[52] U.S. Cl. ..... 430/505; 430/550; 430/551; 430/552; 430/553; 430/567; 430/611

[58] Field of Search ..... 430/505, 551, 550, 544, 430/611, 567, 552, 553

[56] References Cited

U.S. PATENT DOCUMENTS

| | | | |
|---|---|---|---|
| 4,399,215 | 8/1983 | Wey | 430/567 |
| 4,418,140 | 11/1983 | Mifune et al. | 430/551 |
| 4,434,225 | 2/1984 | Sugita et al. | 430/544 |
| 4,448,878 | 5/1984 | Yamamuro et al. | 430/505 |
| 4,528,263 | 7/1985 | Sugita et al. | 430/544 |
| 4,564,591 | 1/1986 | Tanaka et al. | 430/567 |
| 4,590,155 | 5/1986 | Klötzer | 430/376 |
| 4,596,764 | 6/1986 | Ishimaru | 430/505 |
| 4,607,004 | 8/1986 | Ikenoue et al. | 430/505 |
| 4,611,441 | 4/1987 | Kajiwara et al. | 430/555 |
| 4,626,498 | 12/1986 | Shuto et al. | 430/505 |
| 4,737,451 | 4/1988 | Ichijima | 430/544 |
| 4,784,938 | 11/1988 | Obhayashi et al. | 430/505 |

FOREIGN PATENT DOCUMENTS

| | | |
|---|---|---|
| 122125 | 10/1984 | European Pat. Off. . |
| 1492132 | 7/1967 | France . |

OTHER PUBLICATIONS

Research Disclosure 17643 Dec. 1978.

Patent Abstracts of Japan, vol. 9, No. 48 (P-338) [1771] 2/28/85 JPA 59-185335, 10/20/84.

Patent Abstracts of Japan, vol. 10, No. 84 (P-442) [2141] 4/3/86 JPA 60-221747, 11/6/85.

*Primary Examiner*—Paul R. Michl

*Assistant Examiner*—Lee C. Wright

*Attorney, Agent, or Firm*—Jordan B. Bierman

[57] ABSTRACT

A color photographic material is disclosed, which is improved in the preservability of the dye image and in the resistance to the pH fluctuation or the contamination with bleach-fixer of the color developer. The photographic light-sensitive material comprising a support having thereon photographic component layers comprising a blue-sensitive silver halide emulsion layer, a green-sensitive silver halide emulsion layer and a red-sensitive silver halide emulsion layer containing silver halide grains each comprising not less than 90 mol % of silver chloride, a compound represented by the following formula [S] and a cyan coupler represented by the following formula [I].

Formula [S]

Formula [I]

9 Claims, No Drawings

SILVER HALIDE PHOTOGRAPHIC LIGHT-SENSITIVE MATERIAL EXCELLENT IN TREATMENT STABILITY

FIELD OF THE INVENTION

The present invention relates to a silver halide photographic light-sensitive material and, particularly, pertains to a silver halide photographic light-sensitive material with which highly preservable picture images are formed, which permits rapid processing and, further, which is excellent in the processing stability.

BACKGROUND OF THE INVENTION

Of late, in this art, it is desired to provide a silver halide photographic material which permits rapid processing, and produces highly preservable picture images and shows high processing stability and is available at low cost, and, particularly, permits rapid processing.

Thus subjecting a silver halide photographic material to running treatment with an automatic developing machine installed at each developing shop is practiced, but as one means of improvement in service to users, there has been a call for making development and returning the material to the user within the very day on which the request for development is received and, further, even returning the developed material in several hours after the request has been made is desired; as a consequence, need for rapid processing has been all the more enhanced. Further, reduction in the treatment time will lead to improvement in productivity efficiency, thus enabling cost reduction, and to attain this, alacrity in developing rapid processing is urgent.

For attainment of rapid processing, approaches from two phases of photo graphic materials and processing solutions have been taken. With regard to color developing, use of a higher temperature, higher pH, higher concentration of color developing agent, etc., have been tried and, further, use of such additives as development accelerators are known.

Mentioned as the aforementioned development accelerators, 1-phenyl-3-pyrazolidone disclosed in British patent No. 811,185, N-methyl-p-aminophenol disclosed in U.S. Pat. No. 2,417,514 and N,N,N',N'-tetramethyl-p-phenylene diamine disclosed in Japanese patent OPI publication No. 15554/1975, etc. may be cited.

However, these methods can not achieve adequate rapidity and their effect is often accompanied by performance degradation such as greater fogging.

On the other hand, it is known that the configuration, size and composition of the silver halide grains of the silver halide emulsion used in photographic materials have a large bearing on the speed of development, etc.; particularly, the effect of halogen composition is large; especially notably high rate of development is known to be achieved by use of high chlorine content silver halide.

On the other hand, the formation of dye image using silver halide color photographic material is made usually by oxidation of aromatic primary amine color developing agent itself, as it reduces the silver halide grains in the exposed silver halide photographic material, and subsequent formation of dye by reaction of this oxidized product with the couplers contained beforehand in the silver halide color photographic material. And for the couplers, usually, a three layer couplers which form three dyes of yellow, magenta and cyan for making reproduction by way of subtractive color process.

The dye image obtained with silver halide color photographic material is sometimes preserved for a long period under exposure to light or long kept in a dark place under short exposure to light and it is known that a discoloring or fading of the dye image notably, depends on the states of its preservation. Generally, the discoloring or fading of the former is called light discoloring of fading or light fading and discoloring or fading of the latter is called dark discoloring or fading or dark fading. When the color photographic material is kept semipermanently on record, the degree of such light fading or dark fading has to be suppressed to be as small as possible.

Mentioned as basic properties required of couplers are that first, their solubility in high boiling organic solvents, etc., shall be large, that they shall not readily crystalize in silver halide emulsion, their dispersibility and dispersion stability in silver halide emulsions being high, that they shall enable achieving excellent photographic characteristics and that the dye picture images obtained with them shall be fast to light, heat, moisture, etc. Especially, with regard to cyan couplers, attainment of improvement in resistance to heat and moisture, dark fading property, has recently been taken up as an important theme.

Hereto generally used cyan couplers, for example, those disclosed in Japanese patent publication open to public inspection (hereinafter referred to as Japanese patent O.P.I. publication) Nos. 37425/1972, 10135, 25228, 112038, 117422 and 130441/1975 and U.S. Pat. Nos. 2369929, 2423730, 2434272, 2474293 and 2698794 are unsatisfactory, being poor either in light or dark fading, particularly, in the latter.

For this reason, various cyan couplers have been examined in an effort to achieve improvement in the dark fading. As a result, for example, 2,5-diacyl amino type cyan couplers which are disclosed in U.S. Pat. No. 2895826 and Japanese patent O.P.I. publication Nos. 112038/1975, 109630/1978 and 163537/1980 and phenol type cyan couplers having an alkyl group with 2 or more carbon atoms at the fifth position which are disclosed in U.S. Pat. Nos. 3772002 and 4443536 have been found out to be cyan couplers excellent in the dark fading.

Generally, processing of silver halide photographic high-sensitive material is continuously run, while replenishing the processing solutions at various developing shops such as photographic laboratories, etc. In this situation, it is impossible to maintain the compositions of the processing solutions constant between the initial period and the latter half period of running and change in the compositions of the processing solutions brings about fluctuations in the photographic characteristics, particularly, graduation variation. This problem is growing more serious with diminishing replenishment of processing solutions in recent years.

It has become clear that when a cyan coupler represented by the general formula [I] is used in a high chloride content silver halide layer, the photographic characteristics are greatly altered by change in the compositions of the processing solutions and variation of conditions, resulting in failure to obtain stable photographic performance, and thus the problem of low processing stability.

What is called processing stability means the degree of fluctuation in sensitometic characteristics of the photographic material relative to fluctuations in the compositions of the treating solutions, pH and temperature and the amounts of compounds other than the components of the processing solutions mixed into it.

Complete prevention of mixing of bleach fixer into developer, of all these events, is nearly impossible, even when the setting of strict replenishing rate, prevention of evaporation and elimination of eluate from the photographic material are implemented; particularly, in roller conveyor or automatic developing machine, the amount of bleaching-fixer mixed into the developer will notably vary with varying amounts treated and depending on the squeezing method and in actual practice, if the replenishing rate of the treating solution has dropped, its replenishment cycle rate will lower, resulting in further difference in the mixing-in rate.

Further, the color developer is held at a high pH, but under the influence of the amount of the solution replenished, oxidation by air, etc., during the continuous operation, fluctuation in pH of color developer is unavoidable.

Variations in photographic performances, in many cases, increase of fogging and graduation change, due to such mixing of bleach-fixer into color developer or fluctuation in pH pose large obstacles to attainment of stable and proper color and gradation reproduction.

Because of the extreme difficulty in preventing the mixing-in of bleach-fixer and the pH fluctuation themselves for reasons above-described, there is a call for development of silver halide photographic materials which give only small changes in photographic properties, even when the mixing-in of bleach-fixer or pH fluctuation occurs, that is, those excellent in the so-called BF (bleach-fixer) mixing-in resistance and pH fluctuation resistance.

With the silver halide color photosensitive materials, dye image is formed by subjecting them to the color developing-etc. after exposure, but with silver halide color photographic materials using high chloride content silver halide emulsion containing coupler which is suitable for rapid processing, the rate of formation of the oxidized product of the color developing agent is often rapider than the reaction of forming dye through the coupling reaction between the aforementioned oxidized product and the coupler. For this reason, the oxidized product of the developing agent exists in large amount; this causes oxidation of the latent image uncleus formed by exposure, thereby inducing bleaching of the latent image; the larger degree of this latent image bleaching seems to be cause for increasing processing fluctuation of the high silver chloride content photosensitive materials.

Particularly, the high chloride content silver halide provides high speed development, but is known to generally have low resistance to the latent image bleaching by the oxidized product of the developing agent which is formed in excess.

SUMMARY OF THE INVENTION

It is a first object of the invention to provide a silver halide color photosensitive material which enables rapid processing and which further excels in image preservability, and it is a second object to provide a silver halide photosensitive material which enables rapid treatment and which further excels in the BF mixing-in and pH-fluctuation resistance. The above-described objects of this invention have been achieved by a silver halide photographic light-sensitive material comprising a support having thereon photographic component layers comprising a blue-sensitive silver halide emulsion layer, a green-sensitive silver halide emulsion layer and a red-sensitive silver halide emulsion layer, wherein said red-sensitive silver halide emulsion layer contains silver halide grains comprising not less than 90 mol % of silver chloride, a compound represented by the following formula [S] and a cyan coupler represented by the following formula [I]:

Formula [S]

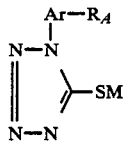

wherein Ar is an arylene group or a cycloalkylene group; $R_A$ is an alkyl group, an alkoxy group, a carboxyl group or its salt, a sulfo group or its salt, a hydroxyl group, an amino group, an acylamino group, a

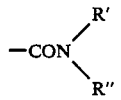

group, an $—NHSO_2R'$ group or an

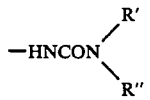

group, R' and R'' being a hydrogen atom an alkyl group or an aryl group, respectively, and M is a hydrogen atom, an alkali metal atom or an ammonium group;

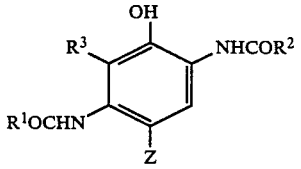

wherein $R^1$ is an alkyl group or an aryl group; $R^2$ is an alkyl group, a cycloalkyl group, an aryl group or a heterocyclic group; $R^3$ is a hydrogen atom, a halogen atom, an alkyl group or a alkoxy group, $R^3$ and $R^1$ being allowed to form a ring by coupling with $R^1$; Z represent a hydrogen atom or a group capable of being splitted off upon reaction with the oxidized product of an aromatic primary amine color developing agent.

DETAILED DESCRIPTION OF THE INVENTION

In the silver halide photographic material of the invention, a compound represented by the general formula [S] is contained in a red sensitive silver halide layer.

In the general formula [S] mentioned as an arylene group denoted by Ar is, e.g., phenylene, naphthylene group, etc.; or as a cycloalkylene group, e.g., cyclohexylene group, etc.

Mentioned as an alkyl groups given by $R_A$ is, e.g., methyl, ethyl groups, etc.; as alkoxy groups, e.g., methoxy, propoxy groups, etc.; as acyl amino groups, e.g., acetyl amino, hexanoyl amino, benzoyl amino groups, etc.; as

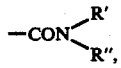

e.g., N-methyl carbamoyl, and N-phenyl carbamoyl groups, etc.; as $-NHSO_2R'$, e.g., methyl sulfonyl amino and benzene sulfonamide groups, etc., or as

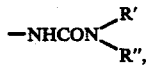

e.g., ureido, N-methyl rueido, N-ethyl rueido, N,N-dimethyl rueido, N,N-diethyl rueido, N-phenyl rueido, etc. Groups represented by $R_A$ further include those having substituents. Mentioned as an alkali metal atom represented by M is, e.g., a sodium atom or potassium atom, etc.

In the following, typical examples of compounds represented by the general formula [S] are given, but this invention is not restricted thereto:

General formula

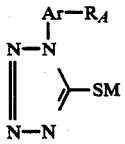

| Example No. | $-Ar-R_A$ | M |
|---|---|---|
| S-1 | 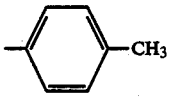 | H |
| S-2 | 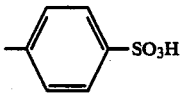 | H |
| S-3 | 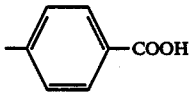 | H |
| S-4 | 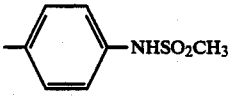 | H |
| S-5 | 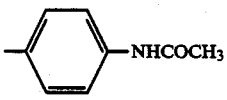 | H |
| S-6 | 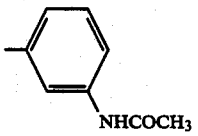 | H |
| S-7 | 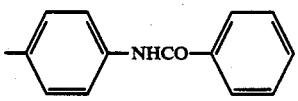 | Na |

-continued

General formula

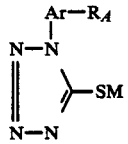

| Example No. | $-Ar-R_A$ | M |
|---|---|---|
| S-8 | 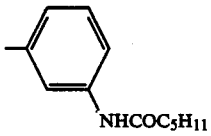 | K |
| S-9 | 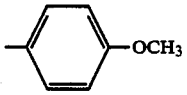 | H |
| S-10 | 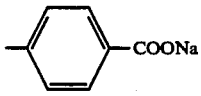 | Na |
| S-11 | 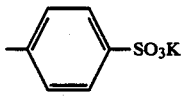 | K |
| S-12 | 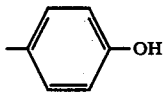 | H |
| S-13 | 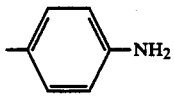 | H |
| S-14 | 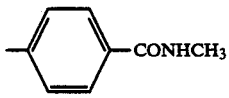 | H |
| S-15 | 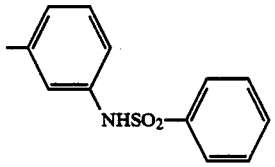 | H |
| S-16 | 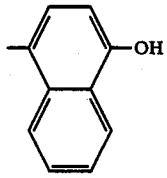 | H |

-continued

General formula

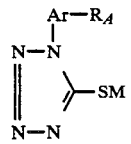

| Example No. | —Ar—$R_A$ | M |
|---|---|---|
| S-17 | 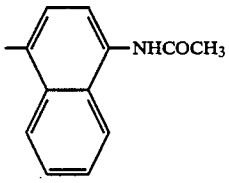 | H |
| S-18 | 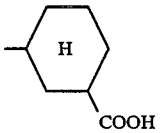 | H |
| S-19 | 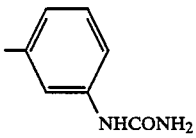 | H |
| S-20 | 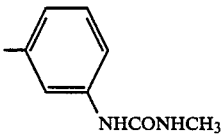 | H |
| S-21 | 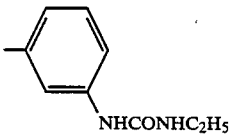 | H |
| S-22 | 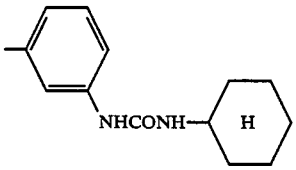 | H |
| S-23 | 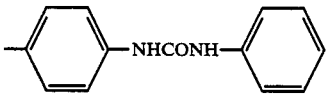 | H |
| S-24 | 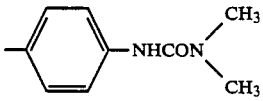 | H |
| S-25 | 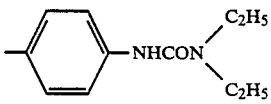 | H |

-continued

General formula

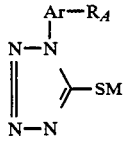

| Example No. | —Ar—$R_A$ | M |
|---|---|---|
| S-26 | 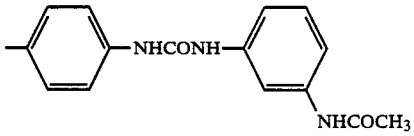 | H |
| S-27 | 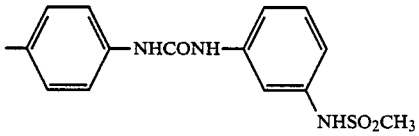 | H |
| S-28 | 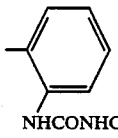 | H |

Compounds represented by the aforementioned formula [S] may be synthesized in accordance with the methods which appear in, e.g., U.S. Pat. No. 3259976 and Japanese patent O.P.I. publication Nos. 14836 and 167023/1982, 95728/1983 and 68732/1984, etc.

For having the compound represented by the general formula [S], hereinafter called compound [S], contained in the silver halide emulsion layers of this invention, it should be added after dissolving it in water or some organic solvent (e.g., methanol, ethanol, etc.) which is arbitrarily mixed with water. The compound [S] may be used single or in combination with other compounds represented by the general formula [S] or any of stabilizers or fogging restrainers other than those represented by the general formula [S].

Suitable time for adding the compound [S] may be any arbitrary time before forming the silver halide grains, while forming the silver halide grains, after completion of the silver halide grain forming but before starting chemical ripening, during the chemical ripening, at the time when the chemical ripening has completed or after accomplishing the chemical ripening but before coating. Preferably, it should be added during chemical ripening, at the time when the chemical ripening has completed or after accomplishing the chemical ripening but before coating. The adding of all amount may be done at a time or at several steps.

With regard to where it is to be added, it may be directly added to silver halide emulsion or to the coating solution of silver halide emulsion or it may be added to the coating solution for non-light-sensitive hydrophilic colloidal layers located adjacent thereto so that it is to be contained in the silver halide emulsion layers of this invention by its diffusion thereinto at the time of coating multilayers.

Its amount added is not particularly limited, but normally, it is from $1\times10^{-6}$ mol to $1\times10^{-1}$ mol, or preferably, from $1\times10^{-5}$ mol to $1\times10^{-2}$ mol per mol of silver halide.

Some of the compounds [S] of the invention are compounds known in this as stabilizers or fog inhibitors. For example, they are disclosed in British patent No. 1273030, Japanese patent publication Nos. 9936/1983, 27010/1985 and Japanese patent O.P.I. publication Nos. 102639/1976, 22416/1978, 59463 and 79436/1980, and 232342/1984, etc. In the aforementioned well-known literatures, descriptions on fogging inhibition and stabilization of emulsion appear, but the effect of the invention or the fact that it is effective against processing fluctuation which occurs when subjecting to a color development the silver halide color photographic material containing high silver chloride content silver halide grains and a specified cyan coupler has heretofore been quite unknown.

And the compounds (S) are generally known as compounds which show such actions as fogging restriction, etc., while accompanying desensitization and inhibited development, descriptions appear in "Fundamentals of Photographic Engineering, Silver Salt Photography", compiled by Photographic Society of Japan Corona Company, 1979, p.195, etc., but the fact that the treatment stability is improved by making use of these compounds in the system of this invention was a quite unexpected effect.

The reasons why this effect which seems singular does arise have yet to be elucidated, but a discussion on its mechanism may be dared as follows:

The color developing, as hereabove-described, consists of the so-called "silver development" process in which the exposed silver halide is reduced to silver by the color developing agent and the so-called "color forming" process in which the oxidized product of the color developing agent formed by the aforementioned reaction and a dye forming coupler make a coupling reaction, yielding a dye. The system of this invention having combined the high silver chloride content silver halide emulsion and the dye forming coupler is a system in which the "silver development" process is very rapid, but the "color forming" process is slow. Accordingly, on the perimeter of the silver halide grains, there exists a high concentration of the oxidized product of the color developing agent which is formed by the "silver development". In this state, a phenomenon of the so-called "latent image bleaching" may take place in which the oxidized product of the color developing agent which exists in a large amount conversely bleaches the "latent image" produced by exposure on the silver halide grains, thereby turning it into an undeveloped state, resulting in reduced color density. By this reasoning, the fact that the improvement in color formation can not be achieved as expected mereby by using the high silver chloride content emulsion may be interpreted and the effect of this invention will be understood by assuming that the "latent image" is strengthened against bleaching by the use of the compound [S].

The silver halide grains, according to this invention, desirably contain 0.5 to 5 mol % of silver bromide, rather than pure silver chloride, and this very small amount of silver bromide may have some part in the "latent image reinforcement".

The aforementioned discussion is in anyway a supposition; the real facts are still indistinct.

In the red-sensitive silver halide emulsion layer of the silver halide photographic material of this invention, silver halide grains with silver chloride content not less than 90 mol % are contained.

The silver halide grains of this invention have a silver chloride content not less than 90 mol %, and preferably have a silver bromide content not more than 10 mol % and silver iodide content not more than 0.5 mol %. More preferably, they are silver chlorobromide having silver bromide content 0.1 1 mol %.

The silver halide grains of this invention may be used singly or in combination with other silver halide grains different in composition therefrom. Or they may be used in mixture with silver halide grains having silver chloride contents more than 10 mol %.

In the silver halide emulsion layer containing silver halide grains having silver chloride content not less than 90 mol % of this invention, the proportion of the silver halide grains with silver chloride content not less than 90 mol % in proportion to the total silver halide grains contained in the aforementioned emulsion layer is not less than 60% by weight, preferably, not less than 80% by weight.

The composition of the silver halide grains of this invention may be uniform from the interior to the exterior of the grain or its composition may be different between its interior and exterior. And when the composition of a grain is different between its interior and exterior, the composition may be continuously altered or may be discrete.

The grain size or diameter of the silver halide grains of this invention, which is not particularly limited, is preferably from 0.2 to 1.6 μm, or more preferably, in the range of from 0.25 to 1.2 μm, taking account of other photographic performances, etc., such as rapid treatability, sensitivity, etc. The aforementioned grain size may be measured by various methods which are generally utilized in the pertinent technical field. Representative methods appear in Lapland's "Grain Size Analyzing Method" (A.S.T.M. Symposium on Light Microscopy, 1955, pp. 94–122) or "Theory of Photographic Process" (Chapter 2, coauthered by Meese and James, 3-rd Edition, issued by MacMillan Company (1966)).

The grain size may be measured from the projected area of grain or approximate value of its size. If the grains have substantially uniform shape, the grain size distribution may be appreciably correctly given by their sizes or projected areas.

The distribution of the sizes of the silver halide grains may be polydispersive or monodispersive. Preferably, they are monodispersed silver halide grains with variation coefficient 0.22 or lower, more preferably, 0.15 or less in the grain diameter distribution of silver halide grains. Here, the variation coefficient is a coefficient for giving the spread of the grain size distribution, which is defined by the undermentioned formula:

$$\text{Variation coefficient } (S/r) = \frac{\text{Standard deviation of grain size distribution}}{\text{Mean grain size}}$$

$$\text{Standard deviation of grain size distribution } (S) = \sqrt{\frac{\Sigma(r-ri)^2 ni}{\Sigma ni}}$$

$$\text{Mean grain size } (r) = \frac{\Sigma niri}{\Sigma ni}$$

Where ri designates grain size of individual grains, and ni their number. The grain diameter represents the diameter of silver halide grain, if it is spherical, but the diameter of the image of the circle having the same area as its projected image, if it cubic or a grain of a shape other than sphere.

The silver halide grains used for the emulsion of this invention may be obtained by whichever of acid, neutral or ammonia process. The grains may be grown at once or grown after forming the seed grains. The method of forming the seed grains and growing method may be same or different.

As the system of reacting soluble silver salt with soluble halide, whichever of the normal precipitation method, reverse precipitation method or double jet precipitation method or their combinations is applicable, but products obtained by the simultaneous mixing method is favorable. As one form of double jet precipitation method, pAg-controlled double jet method which appears in Japanese patent O.P.I. publication No. 48521/1979 may be employed.

Further, if need be, use of such solvent for silver halide as thioether, etc., is permissible.

Any arbitrary shape of silver halide grain of this invention is usable, A preferable example is a cube having {100} face as a crystal surface. Besides, grains having such shapes as octahedron, tetradecahedron and dedecahedrons, etc., may be formed by the methods which appear in specifications of U.S. Pat. Nos. 4183756 and 4225666 and Japanese patent O.P.I. publication No. 26589/1980, Japanese patent publication No. 42737/1980, etc., and in such literatures as The Journal of Photographic Science, 21, 39 (1973), etc., and use may be made of them. Further, grains having twin face may be used.

Into the interior and/or the surface of the silver halide grains used in the emulsion of this invention, either one of ions of undermentioned metals may be added, using salts of cadmium, zinc, lead, thallium, salts or complexes of indium, rhodium or iron in the process of forming the grains and/or the process of growing them, for it to be contained therein, or reduction sensitizer nuclei may be provided in the interior and/or the surface of the grains by placing them in an appropriate reducing atmosphere.

From the emulsion containing the silver halide grains of this invention, hereinafter referred to as this invention's emulsion, unnecessary soluble salts may be removed, after accomplishing the growth of silver halide grains, or they may be left contained therein. The removal of such salts may be made, based on the method which appears in Research Disclosure No. 17643.

The silver halide grains used in the emulsion of this invention may be mainly grains wherein latent image nuclei being formed on the surface or those in the interior of grains, but the former is preferable.

The emulsion of this invention may be chemically sensitized by conventional methods: Thus the sulfur sensitizing method making use of compounds containing sulfur which reacts with silver ion or active gelatin, selenium sensitizing method making use of selenium compounds, reduction sensitizing method making use of reducing materials and noble metal sensitizing method making use of gold and other noble metal compounds may be used singly or in combination.

According to the invention, for example, chalcogen sensitizer may be used as the chemical sensitizer. Chalcogen sensitizer is a generic name of sulfur, selenium and tellurium sensitizers, but for photography, sulfur and selenium sensitizers are preferable. Mentioned as the sulfur sensitizers are, e.g., thiosulfuric acid allylthiocarbazide, thiourea, allyl isothiocyanate, cystine, p-toluene thiosulfonate and rhodanine. Besides, the usable are sulfur sensitizers which appear in U.S. Pat. Nos. 1574944, 2410689, 2278947, 2728668, 3501313 and 3656955, West German O.L.S. patent No. 1422869 and Japanese patent O.P.I. publication Nos. 24937/1981 and 45016/1980. The amount of the sulfur sensitizer added may vary over a substantial range, depending on various factors as pH, temperature, size of silver halide grains, but preferably, fall within a range of from about $10^{-7}$ mol to $10^{-1}$ mol per mol silver halide.

Instead of the sulfur sensitizers, selenium sensitizers may be employed. Usable selenium sensitizers include aliphatic isoselenocyanates such as allyl isoselenocyanate, selenourea compounds, selenoketones, selenoamides, selenocarboxylic acid salts and esters, selenophosphates, selenides such as diethyl selenide, diethyl diselenide, etc. Their particular examples appear in U.S. Pat. Nos. 1574944, 1602592 and 1623499.

Further, the reduction sensitization may be jointly applied. Such reducing agents, which are not particularly limited, may include stannous chloride, thiourea dioxide, hydrazine, polyamine, etc.

Besides, compounds of noble metals other than gold, for example, paradium compounds, etc., may be jointly used.

The silver halide grains of this invention may include gold compounds. As the gold compounds used, its valences may be either mono- or tri-valent; thus various gold compounds may be utilized. Representative examples include chloroaurate, potassium chloroaurate, auric trichloride, potassium auric thiocyanate, potassium iodoaurate, tetracyano-auric azide, ammonium aurothiocyanate, pyridyl trichlorogold, gold sulfide, gold selenide, etc.

The gold compounds may be used in such a way as to sensitize silver halide grains or not to substantially contribute to their sensitization.

The amount of gold compound added, which may vary depending on various conditions, is within a range from $10^{-8}$ to $10^{-1}$ mol as a guide line, and preferably, from $10^{-7}$ to $10^{-2}$ mol per mol of silver halide. The time for adding such gold compound may be in whichever process, either at the time of forming grains of silver halide or at the time of physical or chemical digestion or after accomplishing the chemical digestion.

The emulsion of this invention may be spectrally sensitized over any desired wavelength range, using dyes known as sensitizing dyes in photographic art. The sensitizing dyes may be used singly or in combination of two or more of them.

Some super-sensitizer which strengthens the sensitizing effect of the sensitizing dye, being a dye which itself has no spectral sensitizing action or a compound which does not substantially absorb visible light, may be contained in the emulsion, together with the sensitizing dye.

In the following, the cyan couplers represented by the aforementioned general formula [I] of the invention are described:

According to this invention, the alkyl groups designated by $R^1$ in the general formula [I] are either of straight chained or branched chained, which include, e.g., methyl, ethyl, iso-propyl, butyl, pentyl, octyl, nonyl and tridecyl groups, etc.; and the aryl groups include, e.g., phenyl and naphthyl groups, etc. The groups represented by $R^1$ include those having single or a plurality of substituents. The representative substituents introduced into the phenyl group are, e.g., halogen atoms (e.g., atoms such as fluorine, chlorine, bromine, etc.), groups of alkyl (e.g., methyl, ethyl, propyl, butyl and dodecyl, etc.), hydroxyl, cyano, nitro, alkoxy (e.g., methoxy and ethoxy), alkyl sulfonamido (e.g., methyl sulfonamido and octyl sulfonamido, etc.), aryl sulfonamido (e.g., phenyl sulfonamido and naphthyl sulfonamido, etc.), alkyl sulfamoyl (e.g., phenyl sulfamoyl, etc.), alkyl oxycarbonyl (e.g., methyl oxycarbonyl, etc.), aryloxycarbonyl (e.g., phenyl oxycarbonyl, etc.), aminosulfonamido (e.g., N,N-dimethyl amino-sulfonamide, etc.), acyl amino, carbamoyl, sulfonyl, sulfinyl, sulfoxy, sulfo, aryloxy, alkoxy, carboxyl, alkyl carbonyl and arylcarbonyl, etc.

More than of these groups may be introduced in the phenyl group.

The halogen atoms represented by $R^3$ include, e.g., atoms of fluorine, chlorine and bromine, etc.; alkyl groups include, e.g., methyl, ethyl, propyl, butyl and dodecyl groups, etc.; and alkoxy groups include, e.g., methoxy, ethoxy, propyl oxy and butoxy groups, etc. $R^3$ may be coupled with $R^1$ to form a ring.

The alkyl groups represented by $R^2$ in the aforementioned general formula [I] according to the invention include, e.g., methyl, ethyl, butyl, hexyl, tridecyl, pentadecyl and heptadecyl groups and the so-called polyfluoroalkyl groups formed by substitution with fluorine atom.

The aryl groups denoted by $R^2$ include, e.g., phenyl and naphthyl groups and it is preferably phenyl group. The heterocyclic groups designated by $R^2$ include, e.g., pyridyl and furan groups, etc. The cycloalkyl groups represented by $R^2$ include, e.g., cycloprpyl and cyclohexyl groups, etc. The groups represented by $R^2$ include those having single substituent or a plurality of substituents; mentioned as representative substituents introduced into the phenyl group are, e.g., halogen atoms (e.g., atoms such as fluorine, chlorine and bromine, etc.), and groups of alkyl (e.g., methyl, ethyl, propyl, butyl and dodecyl, etc.), hydroxyl, cyano, nitro, alkoxy (e.g., methoxy and ethoxy, etc.), alkyl sulfonamido (e.g., methyl sulfonamido and octyl sulfonamido, etc.), aryl sulfonamido (e.g., phenylsulfonamido and naphthyl sulfonamido, etc.), alkylsulfamoyl (e.g., butyl sulfamoyl, etc.), aryl sulfamoyl (e.g., phenyl sulfamoyl etc.), alkyl oxycarbonyl (e.g., methyl oxycarbonyl, etc.), aryl oxycarbonyl (e.g., phenyl oxycarbonyl, etc.), aminosulfonamido, acyl amino, carbamoyl, sulfonyl, sulfinyl, sulfoxy, sulfo, aryl oxy, alkoxy, carboxyl, alkyl carbonyl and aryl carbonyl, etc. Two or more of these substituents may be introduced into the phenyl group.

Preferable groups represented by $R^2$ include polyfloroalkyl group, phenyl group or halogen atoms, and alkyl alkoxy, alkyl sulfonamide, aryl sulfonamide, alkyl sulfamoyl, aryl sulfamoyl, alkyl sulfonyl, aryl sulfonyl, alkyl carbonyl, aryl carbonyl group and phenyl groups having one or more than two cyano groups as substituents.

The cyan couplers represented by [I] according to this invention should preferably be compounds given by the undermentioned formula [I'].

General formula [I']

-continued

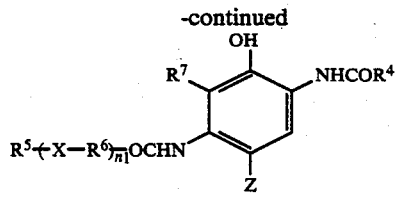

In the general formula [I'], $R^4$ denotes phenyl group. This phenyl group include those having a single substituent or a plurality of substituents and mentioned as representative substituents introduced thereinto are halogen atoms (e.g., atoms such as fluorine, chlorine, bromine, etc.), and groups of alkyl (e.g., methyl, ethyl, propyl, butyl, octyl and dodecyl, etc.), hydroxyl, cyano, notro, alkoxy (e.g., methoxy and ethoxy, etc.), alkyl sulfonamido (e.g., methyl sulfonamido and octyl sulfonamido, etc.), aryl sulfonamido (e.g., phenyl sulfonamido and naphthyl sulfonamido, etc.), alkyl sulfamoyl (e.g., butyl sulfamoyl, etc.), aryl sulfamoyl (e.g., phenyl sulfamoyl, etc.), alkyl oxycarbonyl (e.g., methyl oxycarbonyl, etc.) and aryl oxycarbonyl (e.g., phenyl oxycarbonyl group, etc.). Two or more of these substituents may be introduced on the phenyl group. The preferable groups represented by $R^4$ are phenyl group or substituted phenyl groups having as substituent(s) one or two or more of halogen atoms (preferably atoms such as fluorine, chlorine and bromine), groups of alkyl sulfonamido (preferably, o-methyl sulfonamido, p-octyl sulfonamido and o-dodecyl sulfonamido), aryl sulfonamido (preferably, phenyl sulfonamido), alkyl sulfamoyl (preferably, butyl sulfamoyl), aryl sulfamoyl (preferably, phenyl sulfamoyl), alkyl (preferably, methyl and trifluoromethyl) and alkoxy (preferably, methoxy and ethoxy).

$R^5$ denotes alkyl or aryl group. The alkyl and aryl groups include substituted ones having a single substituent or a plurality of substituents and mentioned as representative such substituents are halogen atoms (e.g., atoms such as fluorine, chlorine and bromine, etc.), hydroxyl, carboxyl, alkyl (e.g., methyl, ethyl, propyl, butyl, oxtyl, dodecyl and benzyl, etc.), cyano, nitro, alkoxy (e.g., methoxy and ethoxy), aryl oxy, alkyl sulfonamido (e.g., methyl sulfonamido and octyl sulfonamido, etc.), aryl sulfonamido (e.g., phenyl sulfonamido and naphthyl sulfonamido, etc.), alkyl sulfamoyl (e.g., butyl sulfamoyl, etc.), aryl sulfamoyl (e.g., phenyl sulfamoyl, etc.), alkyl oxycarbonyl (e.g., methyl oxycarbonyl), aryl oxycarbonyl (e.g., phenyl oxycarbonyl, etc.), aminosulfonamido (e.g., dimethyl aminosulfonamido, etc.), alkyl sulfonyl, aryl sulfonyl, alkylcarbonyl, aryl carbonyl, aminocarbonyl amide, carbamoyl and sulfinyl groups, etc. Two or more kinds of these substituents may be introduced.

Preferable groups represented by $R^5$ are alkyl groups when $n_1=0$, but they are aryl groups when $n_1=1$ or more. Further preferable groups represented by $R^5$ include, when $n_1=0$, alkyl groups having 1 to 22 carbon (preferably, methyl, ethyl, propyl, butyl, octyl and dodecyl) and, when $n_1=1$ or larger, unsubstituted phenyl group or substituted phenyl groups having as substituents one or two or more groups of alkyl (preferably, t-butyl, t-amyl and octyl), alkyl sulfonamide (preferably, butyl sulfonamido, octyl sulfonamido and dodecyl sulfonamido), aryl sulfonamido (preferably, phenyl sulfonamido), aminosulfonamido (preferably, dimethyl aminosulfonamido) and alkyl oxycarbonyl (preferably, methyl oxycarbonyl and butyl oxycarbonyl).

$R^6$ denotes alkylene groups. (Preferably, they should be alkylene groups of straight chain or branched chain having 1 to 20 carbon atoms and more preferably, alkylene groups with 1 to 12 carbon atoms.

$R^7$ designates hydrogen atom or halogen atoms (atoms of fluorine, chlorine, bromine or iodine, etc.). Preferably, it is hydrogen atom.

$n_1$ dentoes 0 or a positive integer; preferably, it is 0 or 1.

X represents such bivalent groups as —0—, —CO—, —COO—, —OCO—, —$SO_2$NR—, NR'$so_2$NR"—, —S—, —SO—, or —$SO_2$—. Where R' and R" are alkyl groups, both R' and R" including those having substituents. The X is preferably —O—, —S—, —SO— and —$SO_2$— groups.

Z is synonymous with Z of the general formula [I].

The groups represented by Z respectively in the formulae [I] and [I'], which are capable of being splitted off by their reaction with the oxidized product of the aromatic primary amine color developing agent, are well known to persons skilled in the art; they provides advantageous actions by modifying the reactivity of coupler or by splitting off from the coupler and discharging such functions as development and bleaching inhibition and color correction in the coated layer or other layers containing the coupler in the silver halide color photosensitive material. Mentioned as representative ones are, e.g., halogen atoms represented by chlorine and fluorine, substituted or unsubstituted alkoxy, aryloxy, arylthio, carbamoyloxy, acyloxy, sulfonyloxy, sulfonamide or heteroylthio, and heteroyloxy groups, etc. Particularly preferable atom as Z is a hydrogen atom or chlorine atom.

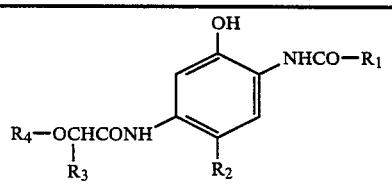

| Examplified Cyan coupler No. | $R_1$ | $R_2$ | $R_3$ | $R_4$ |
|---|---|---|---|---|
| C-1 | 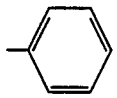 | —Cl | —$C_{12}H_{25}$(n) | 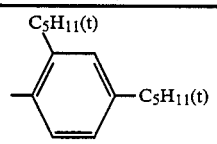 |
| C-2 | 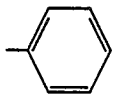 | —Cl | —$C_{12}H_{25}$(n) | 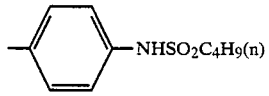 |
| C-3 | 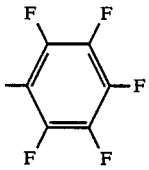 | —Cl | —$C_4H_9$(n) | 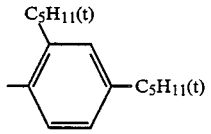 |
| C-4 | 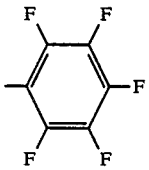 | —$OC_8H_{17}$ | —$C_{12}H_{25}$(n) | 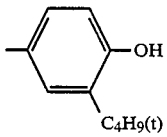 |
| C-5 | 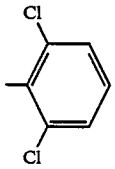 | 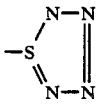 | —$C_{12}H_{25}$(n) | 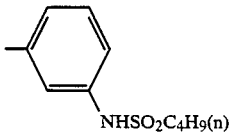 |
| C-6 | 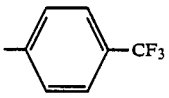 | —$OCH_2COOCH_3$ | —$C_4H_9$(n) | 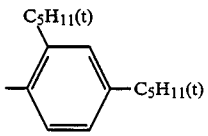 |

-continued
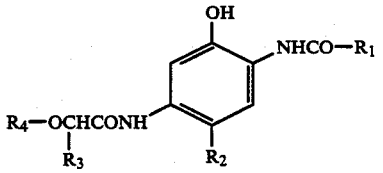
| Examplified Cyan coupler No. | $R_1$ | $R_2$ | $R_3$ | $R_4$ |
|---|---|---|---|---|
| C-7 | 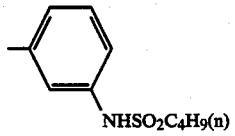 | —Cl | —$C_4H_9$(n) | 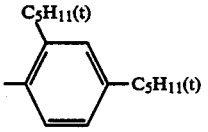 |
| C-9 | 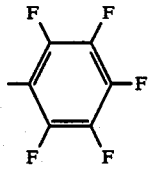 | —Cl | —$C_{12}H_{25}$(n) | 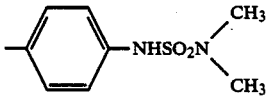 |
| C-10 | 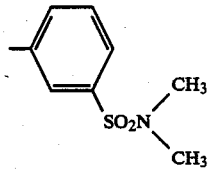 | —Cl | —$C_4H_9$(n) | 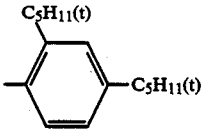 |
| C-11 | 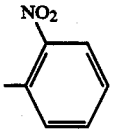 | 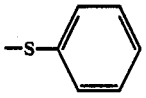 | —$C_4H_9$(n) | 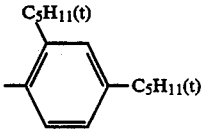 |
| C-12 | 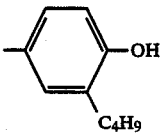 | —Cl | —$C_4H_9$(n) | 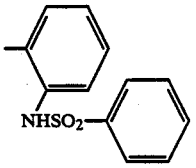 |
| C-13 | 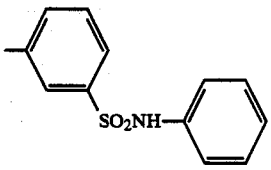 | —Cl | —$C_2H_5$ | 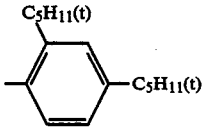 |
| C-14 | 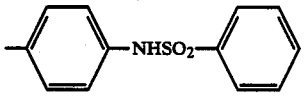 | —Cl | —$C_4H_9$(n) | 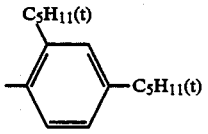 |
| C-17 | 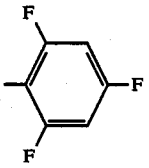 | —Cl | —$C_2H_5$ | 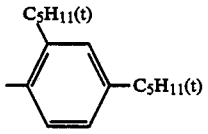 |

-continued
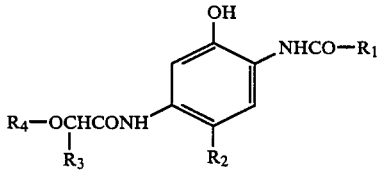
| Examplified Cyan coupler No. | $R_1$ | $R_2$ | $R_3$ | $R_4$ |
|---|---|---|---|---|
| C-18 | 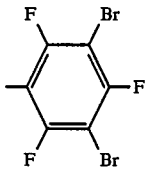 | —Cl | —$C_4H_9$(n) | 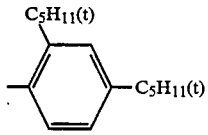 |
| C-19 | 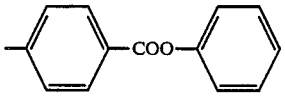 | —Cl | —$C_4H_9$(n) | 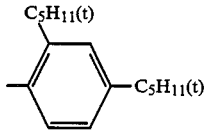 |
| C-20 | 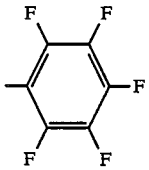 | —H | —$C_4H_9$(n) | 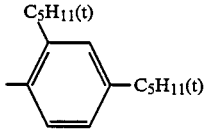 |
| C-21 | 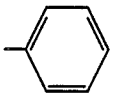 | —Cl | —$C_{12}H_{25}$(n) | 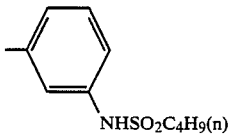 |
| C-22 | 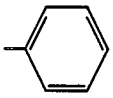 | —Cl | —$C_{12}H_{25}$(n) | 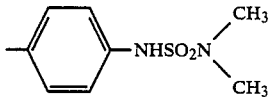 |
| C-23 | 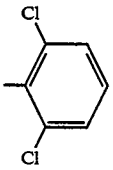 | —Cl | —$C_{12}H_{25}$(n) | 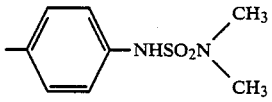 |
| C-24 | 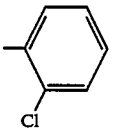 | —Cl | —$C_6H_{13}$(n) | 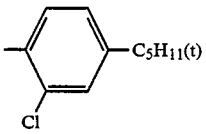 |
| C-25 | 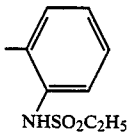 | —Cl | —$C_2H_5$ | 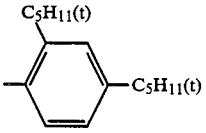 |

-continued
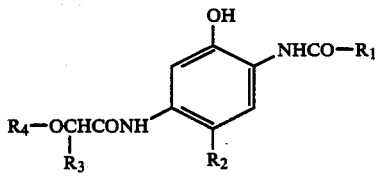
| Examplified Cyan coupler No. | $R_1$ | $R_2$ | $R_3$ | $R_4$ |
|---|---|---|---|---|
| C-29 | 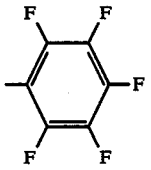 | —Cl | —CH(CH$_3$)$_2$ | 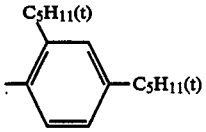 |
| C-31 | 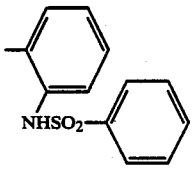 | —Cl | —C$_{10}$H$_{21}$(n) | 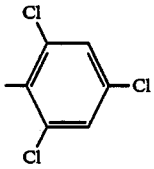 |
| C-33 | 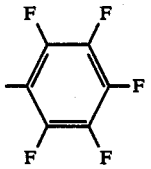 | —Cl | —C$_{12}$H$_{25}$(n) | 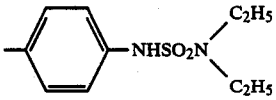 |
| C-34 | 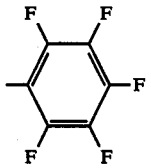 | —CL | —C$_{10}$H$_{21}$(n) | 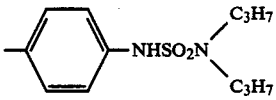 |
| C-35 | 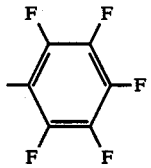 | —Cl | —C$_{12}$H$_{25}$(n) | 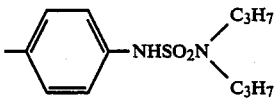 |
| C-36 | 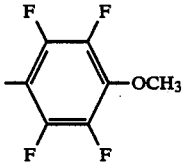 | —Cl | —C$_{12}$H$_{25}$(n) | 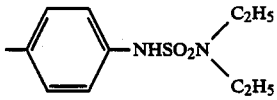 |
| C-37 | 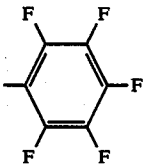 | —Cl | —C$_4$H$_9$(n) | 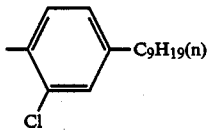 |

-continued
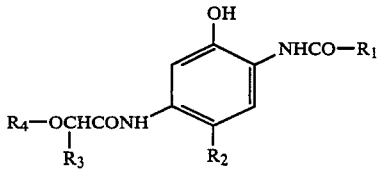
| Examplified Cyan coupler No. | $R_1$ | $R_2$ | $R_3$ | $R_4$ |
|---|---|---|---|---|
| C-38 | 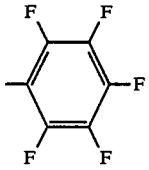 | —Cl | $-C_6H_{13}(n)$ | 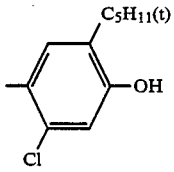 |
| C-39 | 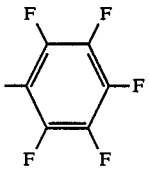 | —Cl | $-C_{12}H_{25}(n)$ | 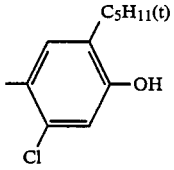 |
| C-40 | 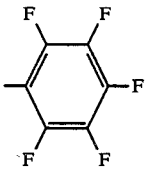 | —Cl | $-C_{12}H_{25}(n)$ | 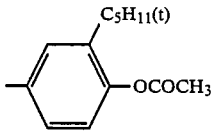 |
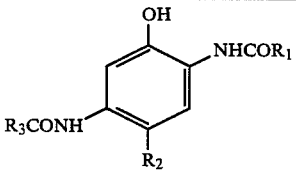
| Examplified Cyan coupler No. | $R_1$ | $R_2$ | $R_3$ |
|---|---|---|---|
| C-8 | 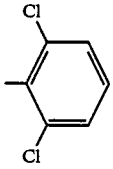 | Cl | 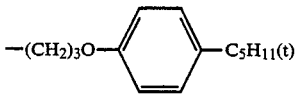 |
| C-15 | 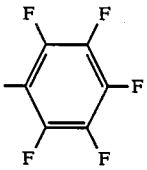 | Cl | 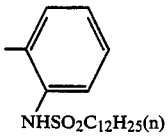 |
| C-16 | 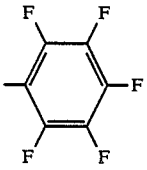 | F | 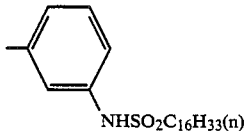 |

-continued

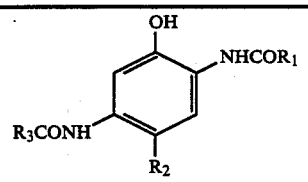

| Examplified Cyan coupler No. | $R_1$ | $R_2$ | $R_3$ |
|---|---|---|---|
| C-26 | 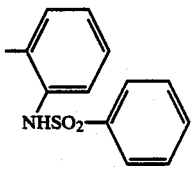 | Cl | 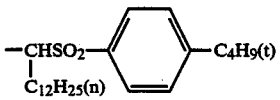 |
| C-27 | $-C(CH_3)_3$ | Cl | 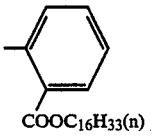 |
| C-28 | 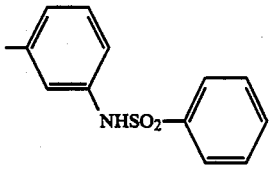 | H | $-CH(C_{12}H_{25}(n))SO_2C_{12}H_{25}(n)$ |
| C-30 | 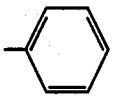 | Cl | 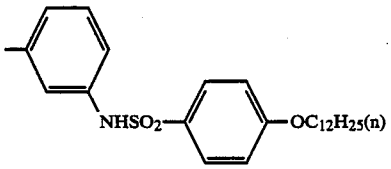 |
| C-32 | 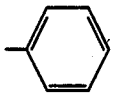 | Cl | $-C_{11}H_{23}(n)$ |

In the silver halide emulsion layers of the silver halide photosensitive material of this invention, there is used a coupler being capable of forming dye by coupling reaction with the oxidized product of aromatic primary amine developing agent, e.g., p-phenylene diamine derivatives or aminophenol derivatives, etc. in the color developing process. In an emulsion layer, the dye forming coupler is usually selected so as to form a dye capable of absorbing light covering the sensitive dye spectra of the emulsion layer; in the blue sensitive emulsion layer, a yellow dye-forming coupler; in the green sensitive emulsion layer, a magenta dye-forming coupler; and in red sensitive emulsion layer, the cyan dye-forming coupler of the invention, respectively.

Such a dye-forming coupler has desirably in its molecule a group called ballast group having more than eight carbon atoms to make the coupler undefusable. This dye-forming coupler may be either tetravalent type in which four silver ions need to be reduced for one molecule of dye to be formed or bivalent type in which reduction of only two silver ions is enough. In the dye-forming coupler, compounds which, through coupling reaction of coupler with the oxidized product of the developing agent, release photographically useful fragments such as development accelerator, bleaching accelerator, developer, silver halide solvent, toning agent, hardener, fogging agent, anti-foggant, chemical sensitizer, spectral sensitizer and desensitizer may be contained. With such a dye-forming coupler, some colored coupler which has the effect of color correction or DIR coupler which releases development inhibitor as development advances thereby improving the sharpness and the graininess of the image may be jointly used. In this instance, the DIR coupler is preferably such that the dye formed by this coupler is of the same type as the dye formed from the dye-forming coupler used in the same emulsion layer; however, joint use therewith of some of other couplers which form different types of dye is permissible, if the dye produced therefrom are not made degradation of color purity. A DIR compound which makes coupling reaction with the oxidized product of the developing agent, thereby forming a colorless compound and at the same time, releasing a development inhibitor, may be used in place of the DIR coupler or jointly with this coupler. The DIR coupler and the DIR compound used may include those in which the inhibitor is directly bonded to their coupling site or those in which the inhibitor is bonded to their coupling site through divalent group, such that the inhibitor may be released by the intramolecular nucleophilic reaction or intramolecular electron transfer reaction, etc., within the group released by the coupling reaction, they are called timing DIR coupler and timing DIR compound. And the inhibitor(s), some being difusible and others not so difusible, may be used singly or jointly, depending on the intended use. Some colorless couplers which make coupling reaction with the oxide product of the aromatic primary amine developer, but which do not form any dyes may be jointly used with the dye-forming couplers.

As yellow dye-forming couplers, acyl acetanilide couplers may be preferably employed. Of these couplers, benzoyl acetanilide base and pivaloyl acetanilide compounds are useful. Preferably, they are compounds represented by the undermentioned formula [Y].

General formula [Y]

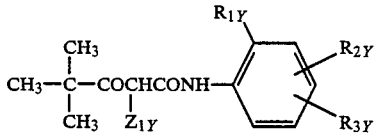

Where $R_{1Y}$ denotes a halogen atom or alkoxy group. $R_{2Y}$ represents a hydrogen atom, halogen atom or alkoxy group. $R_{3Y}$ represents acyl amino, alkoxy carbonyl, alkyl sulfamoyl, aryl sufamoyl, aryl sulfonamide, alkyl ureido, aryl ureido, succinimide, alkoxy or aryl oxy group. $Z_{1Y}$ represents a group being capable of splitting off when they make coupling with a oxidized product of the color developing agent.

Particular examples of usable yellow couplers appear in British patent No. 1077874, Japanese patent publication No. 40757/1970, Japanese patent O.P.I. publication Nos. 1031 and 26133/1972, 94432/1973, 87650/1975, 3631/1976, 115219/1977, 99433 and 133329/1979 and 30127/1981 and U.S. Pat. Nos. 2875057, 3253924, 3265506, 3408194, 3551155, 3551156, 3664841, 3725072, 3730722, 3891445, 3900483, 3929484, 3933500, 3973968, 3990896, 4012259, 4022620, 4029508, 4057432, 4106942, 4133958, 4269936, 4286053, 4304845, 4314023, 4336327, 4356258, 4386155 and 4401752, etc.

According to this invention, as the magenta couplers, the well-known 5-pyrazolonic couplers and pyrazoloazolic couplers etc., may be preferably utilized. The couplers represented by the undermentioned are further preferable formula [P] or [a]:

General formula [P]:

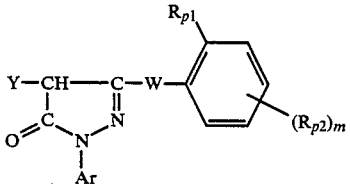

[Where Ar denotes aryl group; $Rp_1$ a hydrogen atom or substituent; and $Rp_2$ a substituent. Y designates a hydrogen atom or group capable of being splitted off upon reaction of the oxidized product of the color developing agent with the coupler residue; W, —NH—, —NHCO— (a nitrogen atom is bonded to the carbon atom of the pyrazolone ring) or —NHCONH—; and m, an integer 1 or 2.]

General formula [a]:

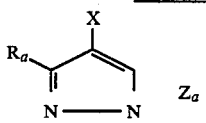

Za represents a nonmetal atom group required for forming nitrogen containing heterocyclic rings and the ring formed by Za may have any substituents.

X stands for hydrogen atom or groups which are removable by their reaction with the oxidized product of the color developing agent.

Ra denotes hydrogen atom or substituents.

Mentioned as substituents represented by the aforementioned Ra include, e.g., a halogen atom and alkyl, cycloalkyl, alkenyl, cycloalkenyl, alkynyl, aryl, heterocyclic, acyl, sulfonyl, sulfinyl, phosphonyl, carbamoyl, sulfamoyl, cyano, spiro compound residue, organic hydrocarbon compound residue, alkoxy, aryloxy, heterocyclicoxy, siloxy, acyloxy, carbamoyloxy, amino, acylamino, sulfonamido, imido, ureido, sulfamoylamino, alkoxycarbonylamino, aryloxycarbonylamino, alkoxycarbonyl, aryloxycarbonyl, alkylthio, arylthio and heterocyclic thio groups.

They appear in specifications of U.S. Pat. Nos. 2600788, 3061432, 3062653, 3127269, 3311476, 3152896, 3419391, 3519429, 3555318, 3684514, 3888680, 3907571, 3928044, 3930861, 3930866 and 3933500, Official Gazettes of Japanese patent O.P.I. publication Nos. 29639, 111631 and 129538/1974, 13041/1975, 58922/1977, 62454 and 118034/1980, 38043/1981, 35858/1982 and 23855/1985, specifications of British patent No. 1247493, Belgian patent Nos. 769116 and 792525 and West German patent No. 2156111, official gazettes of Japanese patent publication No. 60479/1971 and Japanese patent O.P.I. publication Nos. 125732, 228252, 162548 and 171956/1984 and 33552 and 43659/1985, West German patent No. 1070030 and U.S. Pat. No. 3725067.

According to the invention, as the cyan couplers, various phenol or naphthol cyan couplers, in addition to the cyan couplers of this invention, may be jointly used therewith. Of these couplers, those represented by the undermentioned formula [II] may be preferably used:

General formula [II]

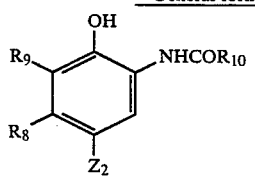

Where $R_{10}$ represents an alkyl group (e.g., methyl, ethyl, propyl, butyl and nonyl groups, etc.). $R_8$ gives an alkyl group (e.g., methyl and ethyl groups, etc.). $R_9$ denotes a hydrogen atom, halogen atom (e.g., fluorine, chlorine, bromine, etc.) or alkyl group (e.g., methyl and ethyl groups, etc.). $Z_2$ designates a group being capable of splitting off by the reaction with the oxidized product of the aromatic primary amine color developing agent.

Particular examples of such cyan couplers appear in specifications of U.S. Pat. No. 2306410, 2356475, 2362598, 2367531, 2369929, 2423730, 2474293, 2476008, 2498466, 2545687, 2728660, 2772162, 2895826, 2976146, 3002836, 3419390, 3446622, 3476563, 3737316, 3758308 and 3839044, and British patent Nos. 478991, 945542, 1084480, 1377233, 1388024 and 1543040; and official gazettes of Japanese patent O.P.I. publication Nos. 37425/1972, 10135, 25228, 112038, 117422 and 130441/1975, 6551, 37647, 52828 and 108841/1976, 109630/1978, 48237, 66129 and 131931/1979, 32071/1980, 146050 and 31953/1984 and 117249/1985.

The couplers used according to this invention may be used usually in each silver halide emulsion layer in the range from $1\times10^{-3}$ to 1 mol, preferably, from $1\times10^{-}$'to $8\times10^{-1}$ mol per mol silver halide.

The aforementioned dye-forming coupler is usually dissolved in a high boiling organic solvent with its boiling point not lower than approx. 150° C., jointly using, as required, a low boiling and/or water soluble organic solvent, and this solution is emulsified and dispersed in a hydrophilic binder such as aqueous gelatin solution, using a surface acgive agent; thereafter, the product is added into the object hydrophilic colloidal layer. A process for removing the low boiling organic solvent after or simultaneously as making the dispersion may be added.

Mentioned as the high boiling organic solvent used according to this invention are esters such as phthalate, phosphorate, etc., organic acid amides, ketones, hydrocarbon compounds, etc.

While the silver halide photographic material of this invention may possibly be, for example, negative film of color negative or positive film as well as color photographic paper, the effect of the method of this invention is effectively exhibited, particularly when the color photographic paper provided for direct viewing is used.

The silver halide phtographic material of this invention including this color photographic paper may be adapted either for monocolor or for multicolor. The multicolor silver halide photographic material normally has a structure of an appropriate number of silver halide emulsion layers containing, as photographic couplers, magenta, yellow and cyan couplers, respectively, and non-light sensitive layers being coated on a support in a proper order to be adaptable for substractive color process color reproduction; this number and order of layers may be arbitrarily varied according to the performances to be emphasized and the object of use.

When the silver halide photographic material of this invention is a multicolor photo sensitive material, particularly preferred as a particular layer composition is one having the yellow dye-image forming layer, intermediate layer, magenta dye-image forming layer, intermediate layer, cyan dye-image forming layer, intermidiate layer and protective layer arranged on a support successively in the order mentioned from the support side.

As the binders, or protective colloid, used for the silver halide photosensitive material of this invention, gelatin may be advantageously utilized, but besides it, usable are hydrophilic colloids including gelatin derivatives, graft polymers of gelatin with other macromolecules, proteins, saccharics, cellulosics, synthetic hydrophilic polymers liked homo or copolymers.

The photographic emulsion layers of silver halide photosensitive material of this invention and other hydrophilic colloidal layers may be hardened by singly or jointly using a hardener which enhances the film strength by bridging the binder or protective colloid molecules. The hardener is desirably added in an amount such that the sensitive material may be hardened to the extent that no hardener need be added to the treating solution, but is also practical to add the hardener into the processing solution.

According to this invention, for hardening the silver halide emulsion layer, chlorotriazine base hardeners represented by the undermentioned formulae [HDA] and [HDB] are preferably employed:

General formula [HDA]

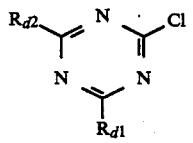

Where Rd denotes chlorine atom and hydroxy, alkyl, alkoxy, alkyl thio, —OM (where M stands for monovalent metal atoms), —NRd'Rd" (where Rd' and Rd" designate, respectively, hydrogen atom, alkyl and aryl groups) or —NHCORd'" (where Rd'" designates hydrogen atom, and alkyl and aryl groups) groups and $Rd^2$ is synonymous with the aforementioned $Rd^1$, but is exclusive of chlorine atom.

General formula [HDB]

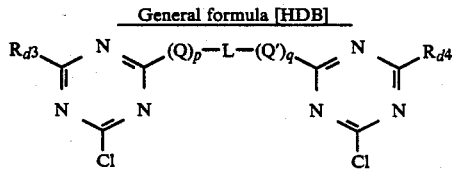

Where $Rd^3$ and $Rd^4$ respectively designate chlorine atom and hydroxy, alkyl, alkoxy or —OM (where M stands for monovalent metal atoms) groups. Codes Q and Q' respectively denote combining groups representing —O—, —S— or —NH—, and L, alkylene or arylene group. Small letters p and q respectively refer to 0 or 1.

In the following, representative preferable particular examples of hardeners represented by the aforementioned formulae [HDA] and [HDB] are listed:

General formula [HDA]

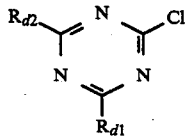

| Compound No. | $R_{d1}$ | $R_{d2}$ |
|---|---|---|
| HD-1 | —OH | —ONa |
| HD-2 | —Cl | —ONa |
| HD-3 | —$OCH_3$ | —ONa |
| HD-4 | —Cl | —$OC_2H_5$ |
| HD-5 | —Cl | —OK |
| HD-6 | —OH | —OK |
| HD-7 | —Cl | —$NH_2$ |
| HD-8 | —Cl | —$NHCOCH_3$ |

-continued

General formula [HDA]

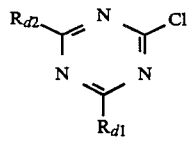

| Compound No. | $R_{d1}$ | $R_{d2}$ |
|---|---|---|
| HD-9 | —OH | —$NHC_2H_5$ |

General formula [HDB]

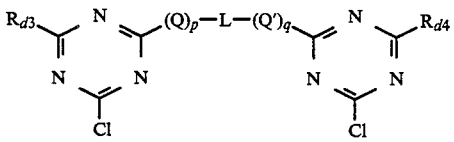

| NO | $R_{d3}$ | $R_{d4}$ | Q | p | Q' | q | L |
|---|---|---|---|---|---|---|---|
| HD-10 | —Cl | —Cl | O | 1 | O | 1 | 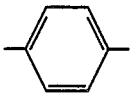 |
| HD-11 | —ONa | —ONa | O | 1 | O | 1 | —$CH_2CH_2$— |
| HD-12 | —ONa | —ONa | — | 0 | — | 0 | —$CH_2CH_2$— |
| HD-13 | —$OCH_3$ | —$OCH_3$ | S | 1 | S | 1 | —$CH_2CH_2$— |
| HD-14 | —ONa | —ONa | H —N— | 1 | H —N— | 1 | —$CH_2CH_2$— |
| HD-15 | —ONa | —ONa | H —N— | 1 | O | 1 | —$CH_2CH_2$— |

For adding the hardener represented by the general formula [HDA] or [HDB] to the silver halide emulsion layer or other photographic component layers, it is dissolved in water of solvents miscible with water (e.g., methanol, ethanol, etc.) and, then, the solution added to the coating solution for the aforementioned component layers. The adding method may be either in batch or in-line way. The adding time is not particularly limited, but it is preferably added immediately before coating the layer.

Such a hardener may be added in an amount of 0.5 to 100 mg, preferably, 2.0 to 50 mg, per g of gelatin coated.

For the purpose of enhancing the flexibility of the silver halide emulsion layers and/or other hydrophilic colloid layers of the silver halide sensitive material of this invention, some plasticizer may be added.

Then, with the aim at improving the dimensional stability of the photographic emulsion layers and other hydrophilic colloidal layers of the silver halide photographic material of this invention, some dispersion (latex) of water insoluble or hardly soluble synthetic polymer may be contained therein.

In the silver halide photographic material of this invention, some image stabilizers for preventing the deterioration of dye image may be used.

For prevention of fogging due to discharge stemming from static charging caused by friction of the photosensitive material and for prevention of deterioration of picture image caused by UV ray, it may contain some UV absorber in the hydrophilic colloid layers such as the protective layer, intermediate layer, etc., of the silver halide photosensitive material of this invention.

In the silver halide photographic material of this invention, a filter layer, anti-halation layer and/or anti-irradiation layer and the auxiliary layers may be provided. In these layers and/or the emulsion layers, some dye which will flow out of the color sensitive material or which will be bleached during the developing may be contained.

With luster reduction of photographic materials, enhancement of retouchability and prevention of mutual sticking of sensitive materials, etc., as the targets, some matting agent may be added into the emulsion layer's and/or the other hydrophilic colloid layers.

To the silver halide photographic material of this invention, some lubricant may be added for reduction of sliding friction.

To the silver halide photographic material of this invention, aome antistatic agent with static prevention as the object may be added. The antistatic agent may be used in the antistatic layer on the side of the support on which no emulsion is laminated or it may be used in the emulsion layer and/or any protective colloid layers other than the emulsion layer on the side of the support on which the emulsion layer is coated.

In the photographic emulsion layer and/or other hydrophilic colloid layers of the silver halide photosensitive material of this invention, various surface active agents may be used with the aims at improvement in coatability, static prevention, improvement in slipping property, emulsification and dispersion, prevention of sticking and improvement in photographic characteristics, such as development promotion, hardening, sensitization, etc.

The silver halide photographic material of this invention may be applied on the photographic emulsion layers, or on other layers including baryta paper or paper formed by laminating & olefin polymer, etc., flexible reflective support of synthetic paper, etc., films formed of semi-synthetic or synthetic macromolecules such as cellulose acetate, cellulose nitrate, polystyrene, polyvinyl chloride, polyethylene terephthalate, polycarbonates and polyamides, etc., glass, metal, ceramics and the like rigid bodies, etc.

The silver halide photographic material of this invention may be coated, as required, on the support surface directly or through one or two or more of primer coating layers for improvement in adhesion, antistatic property, dimensional stability, wear resistance, hardness, anti-halation property, friction characteristic and/or other characteristics, after the support surface has been subjected to corona discharge, UV irradiation and flame treatment, etc.

In applying the photographic material using the silver halide emulsion of this invention, some thickener may be used for improving the coatability. As the coating methods, the extrusion coating and curtain coating which permit simultaneous coating of two or more types of coating are particularly useful.

The sensitive material of this invention may be exposed by using electromagnetic waves in the spectrum region to which the emulsion layer composing the sensitive material of this invention has sensitivity. Usable as the light sources is whichever of well-known light sources including natural light (sunlight), tungsten lamp, fluorescent lamp, mercury lamp, xenon arc light, carbon arc light, xenon flashlight, cathode ray tube flying spot, various laser beams, LED light, and light emitted from phosphors excited by electron beam, X-ray, $\gamma$-ray and $\alpha$-ray.

As for the exposure time, applicable is not only the exposure time of from 1 mili-second to 10 seconds which is normally used in printers, but an exposure of shorter than 1 mili-second, for example, an exposure of 100 micro-seconds to 1 mili-second, using a cathode ray tube or xenon flashlight; and exposure longer than 10 seconds is practical. This exposure may be performed either continuously or intermittently.

Processing method of silver halide photosensitive material of this invention is not particularly limited, but all processing methods are applicable. For example, the processing may be made by whichever method, which is representative, of the method of making bleaching and fixing after color development, if necessary further making water-rinsing and/or stabilizing treatment; making bleaching and fixing separately after color developing and, then, if necessary, further making water-rinsing and/or stabilizing treatment; or the method of performing prehardening, neutralizing, color developing, stopping, fixing, water-rinsing, bleaching, fixing, water-rinsing, post-hardening and water-rinsing in the order mentioned; the method of color developing, water-rinsing, supplementary color developing, stopping, bleaching, fixing, water-rising and stabilziing in the order mentioned; or the developing method in which increasing the amount of dyes formed by first color development is increased by second color development after halogenation-bleaching the developed silver produced by first color development.

The color developer used for processing silver halide emulsion of this invention is an alkaline aqueous solution containing color developing agent with pH desirably 8 or higher, or more preferably, pH 9 to 12. The aromatic primary amine developing agent as this color developing agent is a compound having a primary amino group on the aromatic ring and which is capable of developing exposed silver halide, and further, some precursor which will form such a compound may be added, as required.

As the aforementioned color developing agents, p-phenylene diamine base compounds are representative; following ones may be mentioned as preferable examples:

They include 4-amino—N,N-diethyl aniline, 3-methyl-4-amino-N,N-diethyl aniline, 4-amino-N-ethyl-N-$\beta$-hydroxyethyl aniline, 3-methyl-4-amino-N-$\beta$-hydroxyethyl aniline, 3-methyl-4-amino-N-ethyl-$\beta$-methoxyethyl aniline, 3-methyl-4-amino-N-ethyl-N-$\beta$-methanesulfonamido ethyl aniline, 3-methoxy-4-amino-N-ethylene-N-$\beta$-hydoxyethyl aniline, 3-methoxy-4-amino-N-ethyl-N-$\beta$-methoxyethyl aniline, 3-acetamide, 4-amino-N,N-dimethyl aniline, N-ethyl-N-$\beta$-[$\beta$-(methoxyethoxy)ethoxy)]ethyl-3-methyl-4-aminoaniline and N-ethyl-N-$\beta$-($\beta$-(methoxyethoxy)ethyl-3-methyl-4-aminoaniline, or their salts, for example, sulfate, hydrochloride, sulfite and p-toluene sulfonate, etc.

Mentioned as representative are further thsoe which appear, for example, in Japanese patent O.P.I. publication Nos. 64932/1973, 131526/1975 and 95849/1976 and in the paper of Bent et al., Journal of the American Chemical Society, Vol. 73, pp. 3100 to 3125.

The amount of these aromatic primary amino compound used may be determined by where to set the activity of the developer, but for enhancing the activity, increasing the amount of use is desirable. The amount used ranges from 0.0002 mol/l to 0.7 mol/l. And according to the objective, not less than two compounds may be used in appropriate combination. For example, 3-methyl-4-amino-N,N-diethyl aniline, 3-methyl-4-amino-N-ethyl-N-$\beta$-methane sulfonamide ethyl aniline, 3-methyl4-amino-N-ethyl-N-$\beta$-methane sulfonamide ethyl aniline and 3-methyl-4-amino-N-ethyl-N-hydroxyethyl aniline, etc., may be used freely in whatever combination in keeping with the object.

In the color developer used according to this invention, various components which are usually added, for example, alkali agents such as sodium hydroxide, sodium carbonate, etc., alkali metal sulfite, alkali metal sulfite hydride, alkali metal thiocyanate, alkali metal halide, benzyl alcohol, water softener, thickening agent and development accelerator, etc., may be arbitrarily contained.

Here benzyl alcohol is desirably not be added into the color developer.

Benzyl alcohol gives high BOD and COD, being pollution load values and moreover, because of its low hydrophilic property, benzyl alcohol newly requires diethyl glycol or triethylene glycol as its solvent and these glycols also give high BOD and COD; consequently, the processing solution drained by overflow raises problems of environmental polution. And their solubility in the benzyl alcohol developer is low, with a result that long time is required for preparation of developer or replenishing solution, thus posing an operational problem. If the replenishing amount is large, the number of times of preparation of the replenishing solution will become large; this also provides operational load.

Accordingly, if benzyl alcohol is not substantially contained in color developer, problems in environmental polution and operation are eliminated, which is quite desirable.

As additives besides the aforementioned which may be added to the aforementioned color developer, there are available, e.g., not only compounds for rapid processing solution including bromides such as potassium bromide and ammonium bromide, etc., alkali iodides, nitrobenzimidazole, mercaptobenzimidazole, 5-methylbenzotriazole, 1-phenyl-5-mercaptotetrazole, etc., but anti-stain agents, sludge-proofing agent preservatives, multi-layer effect promotors, chelating agents, etc.

In the color developer used according to this invention, dimethylhydroxylamine, diethylhydroxyamine, tetronic acid, tetronimide, 2-anilinoethanol, dihydroxyacetone, aromatic secondary alcohol, hydroxamic acid, pentose or hexaose, pyrogallol-1,3-dimethyl ether, etc., may be contained as antioxidants, as required.

In the color developer used according to this invention, various chelating agents may be used as sequestering agents. Mentioned as such chelating agents are, e.g., amine polycarboxylic acids such as ethylene diamine tetraacetic acid, diethylene triaminopentaacetic acid, etc., organic phosphonic acids such as 1-hydroxyethylidene-1,1'-diphosphonic acid, etc., aminopolyposphonic acies such as aminotri-(methylene phosphonic acid) or ethylenediaminetetraphosphoric acid, oxycarboxylic acids such as citric acid or gluconic acid, etc., phosphono-carboxylic acids such as 2-phosphonobutane-1,2,4-tricaboxylic acid, polyphosphoric acids such as tripolyphosphoric acid or hexameta-phosphoric acid, etc., polyhydroxy compounds, etc.

The color developing generally is preferably carried out in a time range of 20 to 60 sec., and more preferably in a range of 30 to 50 sec.

As bleaching solutions in the bleaching process or bleaching agent for use in bleaching fixer, such organic acids as aminopolycarboxylic acids or oxalic acid, citric acid, etc., on which such a metal ion as iron or cobalt, copper, etc., is coordinated, are generally known. And as representative examples of the aforementioned aminopolycarboxylic acids, following compounds may be mentioned:

Ethylenediaminetetraacetic acid
Diethylenetriaminepentaacetic acid
Propylenediaminetetraacetic acid
Nitrotriacetic acid
Iminodiacetic acid
Ethylether diaminetetraacetic acid
Ethylenediaminetetrapropionic acid
Disodium ethylenediamine acetate
Pentasodiumdiethylenetriamine pentaacetate
Sodium nitrotriacetate.

The bleaching solution may contain various additives, together with the aforementioned bleaching agents. When bleach-fixer is used in the bleaching process, the solution of a composition containing silver halide fixing agent, besides the aforementioned bleaching agent, may be applied. And in the bleach-fixer, halides such as, for example, potassium bromide may be contained. And similarly as in the case of aforementioned bleaching solution, other additives of various types, for example, pH buffers, fluorescent whitening agents, defoaming agents, surface active agents, preservatives, chelating agents, stabilizers, organic solvents, etc., may be added to be contained therein.

And mentioned as the silver halide fixing agents are compounds which form water soluble silver salts by reaction with silver halide, like those used for normal fixing treatment including, e.g., sodium thiosulfate, ammonium thiosulfate, potassium thiocyanate, sodium thiocyanate or thioruea, thioether, etc.

Various processes such as color development, bleach-fixing (or bleaching and fixing), and further, water rinsing, stabilizing, drying, etc., which may be performed as required are preferably carried out at a processing temperature not lower than 30° C. from the standpoint of rapid treatment.

The silver halide color photosensitive material of this invention may be subjected to stabilizing treatments which take the place of water rinsing and which appear in Japanese patent O.P.I. publication Nos. 14834, 105145, 134634 and 18631/1983 and Japanese patent application Nos. 2709/1983 and 89288/1984.

To the silver halide photosensitive material of this invention composed as hereabove described, it has become possible to impart excellent characteristics that the image preservability is good and that the resistances to BF mixing-in and pH fluctuation are both improved.

EXAMPLE

In the following, the present invention is particularly described in connection with its preferred examples; however, the mode in which this invention is exercised is not limited thereto:

EXAMPLE-1

(Preparation of silver halide emulsion)

By the neutral method and the double jet precipitation method, 22 types of silver chloride emulsion and silver chlorobromide emulsion listed in Table-1 were prepared.

TABLE 1

| Emulsion No. | Ag Cl % | Ag Br % | Average grain size | Chemical sensitizer | Spectral sensitizing dye | Compound [S] *6 or comparative compound *6 |
|---|---|---|---|---|---|---|
| Em-1 | 30 | 70 | 0.50μ | Sodium thiosulfate*1 | SD-3*3 | — |
| Em-2 | 91 | 9 | 0.50μ | Sodium thiosulfate*1 | SD-3*3 | — |
| Em-3 | 98.5 | 1.5 | 0.50μ | Sodium thiosulfate*1 | SD-3*3 | — |
| Em-4 | 100 | 0 | 0.50μ | Sodium thiosulfate*1 | SD-3*3 | S-6 |
| Em-5 | 30 | 70 | 0.50μ | Sodium thiosulfate*1 | SD-3*3 | S-6 |
| Em-6 | 91 | 9 | 0.50μ | Sodium thiosulfate*1 | SD-3*3 | S-6 |
| Em-7 | 98.5 | 1.5 | 0.50μ | Sodium thiosulfate*1 | SD-3*3 | S-6 |
| Em-8 | 100 | 0 | 0.50μ | Sodium thiosulfate*1 | SD-3*3 | S-6 |
| Em-9 | 98.5 | 1.5 | 0.50μ | Sodium thiosulfate*1 | SD-3*3 | Comparative compound-1 |
| Em-10 | 98.5 | 1.5 | 0.50μ | Sodium thiosulfate*1 | SD-3*3 | Comparative compound-2 |
| Em-11 | 98.5 | 1.5 | 0.50μ | Sodium thiosulfate*1 | SD-3*3 | S-12 |
| Em-12 | 98.5 | 1.5 | 0.50μ | Sodium thiosulfate*1 | SD-3*3 | S-14 |
| Em-13 | 98.5 | 1.5 | 0.50μ | Sodium thiosulfate*1 | SD-3*3 | S-8 |
| Em-14 | 98.5 | 1.5 | 0.50μ | Sodium thiosulfate*1 | SD-3*3 | S-20 |
| Em-15 | 98.5 | 1.5 | 0.50μ | Sodium thiosulfate*1 | SD-3*3 | S-24 |
| Em-16 | 98.5 | 1.5 | 0.50μ | Chloroaulic acid *2<br>Sodium thiosulfate*1 | SD-3*3 | S-6 |
| Em-17 | 98.5 | 1.5 | 0.50μ | Chloroaulic acid*2<br>Sodium thiosulfate*1 | SD-3*3 | S-12 |
| Em-18 | 98.5 | 1.5 | 0.50μ | Chloroaulic acid*2<br>Sodium thiosulfate*1 | SD-3*3 | S-20 |

TABLE 1-continued

| Emulsion No. | Ag Cl % | Ag Br % | Average grain size | Chemical sensitizer | Spectral sensitizing dye | Compound [S] *6 or comparative compound *6 |
|---|---|---|---|---|---|---|
| Em-19 | 98.5 | 1.5 | 0.50μ | Chloroaulic acid*2<br>Sodium thiosulfate*1 | SD-3*3 | S-24 |
| Em-20 | 100 | 0 | 0.50μ | Chloroaulic acid*2<br>Sodium thiosulfate*1 | SD-3*3 | S-6 |
| Em-21 | 98.5 | 1.5 | 0.67μ | Sodium thiosulfate*1 | SD-1*4 | — |
| Em-22 | 98.5 | 1.5 | 0.50μ | Sodium thiosulfate*1 | SD-2*5 | — |
| Em-23 | 99.5 | 0.5 | 0.50μ | Sodium thiosulfate*1 | SD-3*3 | Comparative compound-1 |
| Em-24 | 99.5 | 0.5 | 0.50μ | Sodium thiosulfate*1 | SD-3*3 | Comparative compound-2 |
| Em-25 | 99.5 | 0.5 | 0.50μ | Sodium thiosulfate*1 | SD-3*3 | S-12 |
| Em-26 | 99.5 | 0.5 | 0.50μ | Sodium thiosulfate*1 | SD-3*3 | S-14 |
| Em-27 | 99.5 | 0.5 | 0.50μ | Sodium thiosulfate*1 | SD-3*3 | S-8 |
| Em-28 | 99.5 | 0.5 | 0.50μ | Sodium thiosulfate*1 | SD-3*3 | S-20 |
| Em-29 | 99.5 | 0.5 | 0.50μ | Sodium thiosulfate*1 | SD-3*3 | S-24 |
| Em-30 | 99.5 | 0.5 | 0.50μ | Chloroaulic acid*2<br>Sodium thiosulfate*1 | SD-3*3 | S-6 |
| Em-31 | 99.5 | 0.5 | 0.50μ | Chloroaulic acid*2<br>Sodium thiosulfate*1 | SD-3*3 | S-12 |
| Em-32 | 99.5 | 0.5 | 0.50μ | Chloroaulic acid*2<br>Sodium thiosulfate*1 | SD-3*3 | S-20 |
| Em-33 | 99.5 | 0.5 | 0.50μ | Chloroaulic acid*2<br>Sodium thiosulfate*1 | SD-3*3 | S-24 |

*1 2 mg per mol of silver halide added.
*2 $5 \times 10^{-5}$mol per mol of silver halide added.
*3 0.2 milimol per mol of silver halide added.
*4 0.9 milimol per mol of silver halide added.
*5 0.7 milimol per mol of silver halide added.
*6 $1 \times 10^{-3}$mol per mol of silver halide added upon completion of chemical sensitization.

[SD-1]

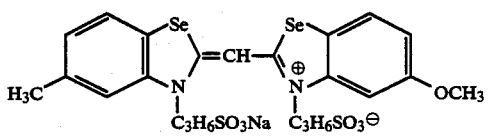

[SD-2]

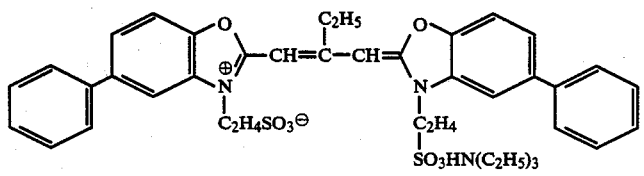

[SD-3]

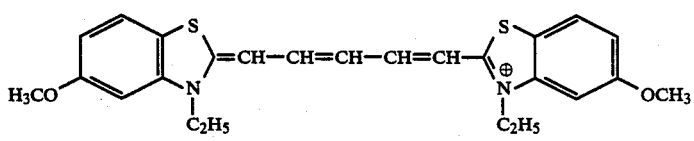

Comparative compound-1

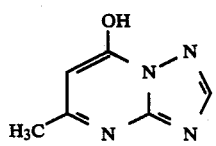

Comparative compound-2

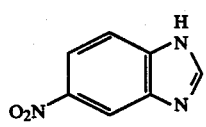

Then silver halide color photographic material ample Nos. 1 throu 33 were prepared by successive coating of the undermentioned layers on a paper support laminated with polyethylene on both surfaces thereof in the order mentioned from the support side:

Layer 1 . . . . . A layer containing 1.2 g/m$^2$ of gelatin, 0.32 g/m$^2$ converted to silver, the same shall apply hereinafter of blue sensitive silver halide emulsion No. 21 as well as 0.80 g/m$^2$ of yellow coupler (Y-1) dissolved in 0.50 g/m$^2$ of dioctylphthalate Layer 2 . . . . . An intermediate layer containing 0.70 g/m$^2$ of gelatin Layer 3 . . . . . A layer containing 1.25 g/m$^2$ gelatin, 0.30 g/m$^2$ of green sensitive silver halide emulsion No. 22, as well 0.52 g/m$^2$ of magenta coupler (M-1) dissolved in 0.30 g/m$^2$ of dioctyl phthalate Layer 4 ..... An intermediate layer containing 1.20 g/m$^2$ of gelatin Layer 5 ..... A layer containing 1.20 g/m$^2$ of gelatin, 0.30 g/m$^2$ of red sensitive silver halide emulsion shown in Table-1, as well as 0.9 milimol/m$^2$ of cyan coupler shown in Table-1 dissolved in 0.20 g/m$^2$ of dioctyl phthalate.

Layer 6 ..... A layer containing 1.00 g/m$^2$ of gelatin, as well as 0.30 g/m$^2$ of the undermentioned UV absorber (UV-1) dissolved in 0.20 g/m$^2$ of dioctyl phthalate Layer 7 ..... A layer containing 0.50 g/m$^2$ of gelatin As a hardener, HD-2 was added into the layers 2, 4 and 7, to be 0.017 g per gram gelatin.

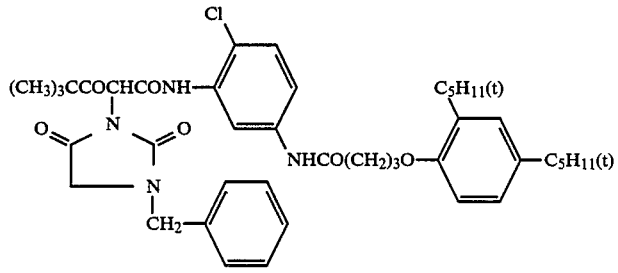

(Y-1)

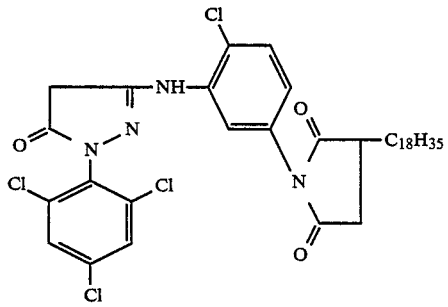

(M-1)

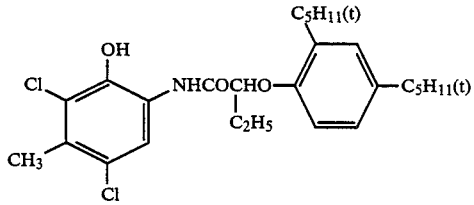

(CC-1)

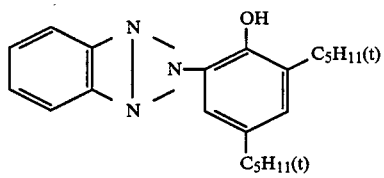

(UV-1)

The samples thus obtained were usbjected to wedge exposure, using an densitometer, type KS-7 (manufactured by Konishiroku Photographic Industry Company) and then, after treating it, following the undermentioned color developing steps, the maximum density in the red sensitive emulsion layer was measured, using an optical densitometer (manufactured by Konishiroku Photographic Industry Company, type PDA-65).

| [Treating processes] | Temperature | Time |
|---|---|---|
| Color developing | 34.7 ± 0.3° C. | 45 sec. |

-continued

| [Treating processes] | Temperature | Time |
|---|---|---|
| Bleach-fixing | 34.7 ± 0.5° C. | 50 sec. |
| Stabilizing | 30–34° C. | 90 sec. |
| Drying | 60–80° C. | 60 sec. |
| [Color developer-A] | | |
| Pure water | | 800 ml |
| Triethanol amine | | 8 g |
| N,N—Diethylhydroxylamine | | 5 g |
| Potassium chloride | | 2 g |
| N—ethyl-N—methanesulfonamidoethyl-3-methyl-4-aminoaniline sulfate | | 5 g |
| Sodium tetrapolyphosphate | | 2 g |
| Potassium carbonate | | 30 g |
| Potassium sulfite | | 0.2 g |
| Fluorescent whitening agent (4,4'-diaminostilbene disulfonic derivative) | | 1 g |

The total amount is brought to 1 l by adding pure water, whereby the pH was adjusted to 10.2.

| [Bleach-fixer] | |
|---|---|
| Ammonium ferric ethylenediaminetetraacetate dihydride | 60 g |
| Ethylenediaminetetraacetic acid | 3 g |
| Ammonium thiosulfate (70% solution) | 100 ml |
| Ammonium sulfite (40% solution) | 27.5 ml |

Water was added to the above ingredients to prepare one l solution which was treated with potassium carbonate or gracial acetic acid to have the pH value of 5.7.

| [Stabilizer] | |
|---|---|
| 5-Chloro-2-methyl-4-isothiazoline-3-on | 1 g |
| 1-Hydroxyethylidene-1,1-diphosphonic acid | 2 g |

Water was added to the above ingredients to prepare one l solution, which was treated with sulfuric acid or potassium hydroxide to have the pH value of 7.0.

Then with this sample, the BF mixing-in resistance test and pH fluctuation resistance test were conducted by the undermentioned methods:

[BF Mixing-in resistance test]

A color developer [B] with 0.4 ml of the aforementioned bleaching fixer added per l of the aforementioned color developer [A] was prepared.

With the sample treated in accordance with the aforementioned color developing treatment using this color developer [B], the sensitometric characteristics of the red sensitive emulsion layer of it were measured.

The results are shown in Table-2. In this table, $\Delta\gamma b$ is, as shown by the undermentioned formula, a valve showing the fluctuation width between the gradient $\gamma(O)$ when the treatment is made with the color developer [A] into which no bleaching fixer has been mixed and the value $\gamma(0.4)$ when the treatment is made with a color developer [B] into which the bleaching fixer has been mixed; the smaller this value, the higher the BF mixing-in resistance:

$$\Delta\gamma b = |\gamma(0) - \gamma(0.4)|$$

The letter $\gamma$ representing gradient is a numeral given by the product of the inverse of the difference of logarithm of the respective exposure dosages required for obtaining the densities of 0.8 and 1.8, multiplied by the difference of the aforementioned densities, the larger values showing higher gradient.

[pH Fluctuation resistance test]

A color developer [C] with the same composition as the aforementioned color developer [A] but adjusted to pH 10.6 was prepared. The sample was treated in accordance with the aforementioned color developing treatment process using this color developer [C] and, then, the sensitometric characteristics of the red sensitive layer of it were measured.

The results are put up in Table-2. In this table, $\Delta\gamma p$ denotes, as shown by the undermentioned formula, a value representing the fluctuation width between the gradient (10.2) when it was treated with the color developer [A] with pH=10.2 and the gradient (10.6) when it was treated with the color developer [C] with pH=10.6:

$$\Delta\gamma p = |\gamma(10.2) - \gamma(10.6)|$$

On the other hand, with the samples which have been subjected to the treatment above-mentioned, dark fading property of the dye image was examined by the method described hereunder:

[Dark fading properties]

After keeping the treated samples in store for 20 dyas at 85° C. and 60% RH, the rate (%) of dye image with the initial density 1.0 was determined.

Results of the above-mentioned tests are listed in Table-2:

TABLE 2

| Sample No. | Silver halide emulsion of layer 5 | Silver chloride content (%) | Compound of formula [S] or comparative compound | Cyan coupler | Maximum density | BF Mixing-in resistance Δγb | pH Fluctuation resistance Δγb | Dark fading rate (%) | Remark |
|---|---|---|---|---|---|---|---|---|---|
| | Em-1 | 30 | — | C-33 | 1.79 | 0.79 | 0.61 | 92.2 | Comparative |
| 2 | Em-2 | 91 | — | C-33 | 2.61 | 0.67 | 0.48 | 93.0 | Comparative |
| 3 | Em-3 | 98.5 | — | C-33 | 2.70 | 0.65 | 0.52 | 92.7 | Comparative |
| 4 | Em-4 | 100 | — | C-33 | 2.69 | 0.73 | 0.59 | 92.8 | Comparative |
| 5 | Em-5 | 30 | S-6 | C-33 | 1.69 | 0.40 | 0.45 | 92.7 | Comparative |
| 6 | Em-6 | 91 | S-6 | C-33 | 2.54 | 0.23 | 0.23 | 92.8 | This invention |
| 7 | Em-7 | 98.5 | S-6 | C-33 | 2.69 | 0.20 | 0.22 | 92.9 | This invention |
| 8 | Em-8 | 100 | S-6 | C-33 | 2.58 | 0.25 | 0.24 | 92.7 | This invention |
| 9 | Em-9 | 98.5 | Comparative compound-1 | C-33 | 2.51 | 0.43 | 0.50 | 92.6 | Comparative |
| 10 | Em-10 | 98.5 | Comparative compound-2 | C-33 | 2.46 | 0.52 | 0.47 | 92.7 | Comparative |
| 11 | Em-11 | 98.5 | S-12 | C-33 | 2.64 | 0.21 | 0.25 | 92.4 | This invention |
| 12 | Em-12 | 98.5 | S-14 | C-33 | 2.67 | 0.24 | 0.25 | 92.7 | This invention |
| 13 | Em-13 | 98.5 | S-8 | C-33 | 2.67 | 0.25 | 0.24 | 92.5 | This invention |
| 14 | Em-14 | 98.5 | S-20 | C-33 | 2.66 | 0.28 | 0.21 | 92.6 | This invention |
| 15 | Em-15 | 98.5 | S-24 | C-33 | 2.70 | 0.26 | 0.19 | 92.8 | This invention |
| 16 | Em-16 | 98.5 | S-6 | C-33 | 2.71 | 0.17 | 0.16 | 92.3 | This invention |
| 17 | Em-17 | 98.5 | S-12 | C-33 | 2.68 | 0.19 | 0.18 | 92.9 | This invention |
| 18 | Em-18 | 98.5 | S-20 | C-33 | 2.65 | 0.21 | 0.16 | 92.7 | This invention |
| 19 | Em-19 | 98.5 | S-24 | C-33 | 2.64 | 0.23 | 0.15 | 92.6 | This invention |
| 20 | Em-20 | 100 | S-6 | C-33 | 2.60 | 0.24 | 0.18 | 92.8 | This invention |
| 21 | Em-1 | 30 | — | CC-1 | 1.82 | 0.32 | 0.38 | 42.5 | Comparative |
| 22 | Em-2 | 91 | — | CC-1 | 2.63 | 0.35 | 0.25 | 41.8 | Comparative |
| 23 | Em-3 | 98.5 | — | CC-1 | 2.72 | 0.36 | 0.27 | 42.1 | Comparative |
| 24 | Em-4 | 100 | — | CC-1 | 2.68 | 0.41 | 0.30 | 41.9 | Comparative |
| 25 | Em-5 | 30 | S-6 | CC-1 | 1.75 | 0.33 | 0.46 | 41.7 | Comparative |
| 26 | Em-6 | 91 | S-6 | CC-1 | 2.60 | 0.26 | 0.29 | 41.9 | Comparative |
| 27 | Em-7 | 98.5 | S-6 | CC-1 | 2.67 | 0.24 | 0.30 | 42.1 | Comparative |
| 28 | Em-8 | 100 | S-6 | CC-1 | 2.63 | 0.25 | 0.27 | 41.8 | Comparative |
| 29 | Em-7 | 98.5 | S-6 | C-29 | 2.59 | 0.25 | 0.25 | 92.9 | This invention |
| 30 | Em-11 | 98.5 | S-14 | C-24 | 2.51 | 0.26 | 0.23 | 88.9 | This invention |

TABLE 2-continued

| Sample No. | Silver halide emulsion of layer 5 | Silver chloride content (%) | Compound of formula [S] or comparative compound | Cyan coupler | Maximum density | BF Mixing-in resistance Δγb | pH Fluctuation resistance Δγb | Dark fading rate (%) | Remark |
|---|---|---|---|---|---|---|---|---|---|
| 31 | Em-12 | 98.5 | S-8 | C-9 | 2.58 | 0.27 | 0.24 | 92.6 | This invention |
| 32 | Em-13 | 98.5 | S-20 | C-39 | 2.61 | 0.29 | 0.19 | 92.3 | This invention |
| 33 | Em-14 | 98.5 | S-24 | C-15 | 2.58 | 0.28 | 0.15 | 92.2 | This invention |
| 34 | Em-23 | 99.5 | Comparative compound-1 | C-33 | 2.53 | 0.41 | 0.48 | 92.7 | Comparative |
| 35 | Em-24 | 99.5 | Comparative compound-2 | C-33 | 2.49 | 0.49 | 0.47 | 92.7 | Comparative |
| 36 | Em-25 | 99.5 | S-12 | C-33 | 2.66 | 0.20 | 0.22 | 92.6 | This invention |
| 37 | Em-26 | 99.5 | S-14 | C-33 | 2.68 | 0.22 | 0.23 | 92.5 | This invention |
| 38 | Em-27 | 99.5 | S-8 | C-33 | 2.70 | 0.22 | 0.23 | 92.6 | This invention |
| 39 | Em-28 | 99.5 | S-20 | C-33 | 2.71 | 0.25 | 0.20 | 92.5 | This invention |
| 40 | Em-29 | 99.5 | S-24 | C-33 | 2.73 | 0.24 | 0.17 | 92.4 | This invention |
| 41 | Em-30 | 99.5 | S-6 | C-33 | 2.75 | 0.16 | 0.14 | 92.2 | This invention |
| 42 | Em-31 | 99.5 | S-12 | C-33 | 2.71 | 0.18 | 0.16 | 92.3 | This invention |
| 43 | Em-32 | 99.5 | S-20 | C-33 | 2.70 | 0.19 | 0.14 | 92.8 | This invention |
| 44 | Em-33 | 99.5 | S-24 | C-33 | 2.70 | 0.21 | 0.12 | 92.7 | This invention |

Table-2 clearly shows that Samples 1, 5 and 21, 25 employ silver halide emulsions having as low as 30 mol % silver chloride content; therefore, their rapid development adaptability is vary low; they fail to achieve the maximum density in the developing time of 45 seconds.

And Comparative samples 21 to 28 which make use of comparative cyan coupler CC-1 all give very high dark fading rates, such that they can not bear practical use, even if they have rapid development adaptability.

On the other hand, Sample Nos. 2 to 4 which make use of silver halide grains with silver chloride contents higher than 90 mol % and the cyan coupler of this invention are provided with rapid development adaptability and low dark fading rates, and when the developing treatment is performed with an ideal color developer in which no bleach-fixer is mixed in at all and, moreover, pH is not deviated from the standard value, they give proper photographic performance, but it is apparent that if the treatment is made with a color developer in which only a small amount of bleach-fixer is mixed in or its pH is deviated from the standard value, the gammer value greatly fluctuates.

On the other hand, it is understood that in Sample Nos. 6 to 8, 11 to 20 and 29 to 33 containing silver halide grains with silver chloride content not less than 90 mol %, cyan coupler of this invention and a compound represented by the general formula [S] of this invention, the dark fading rate is proper, the rapid development adaptability is not impaired, and moreover, the BF mixing-in resistance and the pH fluctuation resistance are greatly improved. More precisely, Sample Nos. 7 and 16 containing only small amount of silver bromide, as compared with Sample Nos. 8 and 20 using pure silver chloride as the silver halide, show further improvement in the BF mixing-in resistance and pH fluctuation resistance. And in Sample Nos. 16 to 20 which use gold compounds as the sensitizer, as compared with Sample Nos. 7, 11, 14, 15 and 8 which do not utilize gold compounds as the sensitizer, improvements in the BF mixing-in resistance and pH fluctuation resistance are recognized.

In Sample Nos. 9 and 10 which employ Comparative compound −1 and −2 which are not covered by this invention, slight improvements in the BF mixing-in resistance and pH fluctuation resistance are recognized, but this effect can not be said adequate.

As described in the foregoing, it will be understood that only when the silver halide grains with silver chloride content not less than 90 mol %, the cyan coupler of this invention and the compound represented by the general formula [S] of this invention are all employed, silver halide photosensitive materials are obtainable which satisfy all that is intended by this invention of the rapid treatment adaptability, picture image preservability, BF mixing-in resistance and pH fluctuation resistance.

EXAMPLE 2

Similar samples as that of Sample No. 7, except that in place of the compound S-6 represented by the general formula [S], as used in Sample No. 7 of Example-1, compounds S-1, S-9, S-11, S-13, S-15 and S-18 were respectively employed, were prepared and evaluated similarly as in Example-1. Results showed nearly similar effects as obtained in Example-1.

What is claimed is:

1. A silver halide photographic light-sensitive material comprising a support having thereon photographic component layers comprising a blue-sensitive silver halide emulsion layer, a green-sensitive silver halide emulsion layer and a red-sensitive silver halide emulsion layer, wherein said red-sensitive silver halide emulsion layer contains silver halide grains comprising not less than 90 mol % of silver chloride, a compound represented by the following formula [S] and a cyan coupler represented by the following formula [I]:

Formula [S]

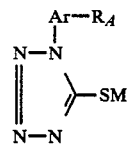

wherein Ar is an arylene group or a cycloalkylene group; $R_A$ is an alkyl group, an alkoxy group, a carboxyl group or its salt, a sulfo group or its salt, a hydroxyl group, an amino group, an acylamino group, a

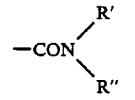

group, an —$NHSO_2R''$ group or an

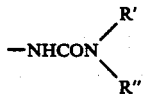

group, R' and R'' being a hydrogen atom an alkyl group or an aryl group, respectively, and M is a hydrogen atom, an alkali metal atom or an ammonium group;

Formula [I]

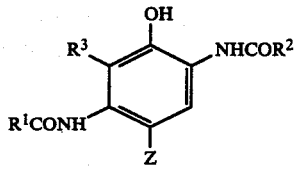

wherein $R^1$ is an alkyl group or an aryl group; $R^2$ is an alkyl group, a cycloalkyl group, an aryl group or a heterocyclic group; $R^3$ is a hydrogen atom, a halogen atom, an alkyl group or a alkoxy group, $R^3$ and $R^1$ being allowed to form a ring by coupling with $R^1$; Z represent a hydrogen atom or a group capable of being splitted off upon reaction with the oxidized product of an aromatic primary amine color developing agent.

2. The silver halide photographic light-sensitive material of claim 1, wherein said silver halide grains are essentially consisting of silver chlorobromide containing from 0.1 to 1 mol % of silver bromide.

3. The silver halide photographic light-sensitive material of claim 1, wherein said red-sensitive emulsion layer contains said silver halide grains comprising not less than 90 mol % of silver chloride in an proportion of at least 60% by weight to the total weight of silver halide contained in said emulsion layer.

4. The silver halide photographic light-sensitive material of claim 3, wherein said red-sensitive emulsion layer contains said silver halide grains comprising not less than 90 mol % of silver chloride in an proportion of at least 80% by weight to the total weight of silver halide contained in said layer.

5. The silver halide photographic light-sensitive material of claim 1, wherein said red-sensitive silver halide emulsion layer contains a gold compound.

6. The silver halide photographic light-sensitive material of claim 1, wherein said red-sensitive silver halid emulsion layer contains said compound represented by the formula [S] in an amount of from $1\times10^{-6}$ to $1\times10^{-1}$ mol per mol of silver halide contained in said silver halide photographic layer.

7. The silver halide photographic light-sensitive material of claim 6, wherein said red-sensitive silver halide emulsion layer contains said compound represented by the formula [S] in an amount of from $1\times10^{-5}$ to $1\times10^{-2}$ mol per mol of silver halide contained in said silver halide photographic layer.

8. The silver halide photographic light-sensitive material of claim 1, wherein said coupler represented by the formula [I] is selected from the couplers represented by the following formula [I']:

Formula [I']

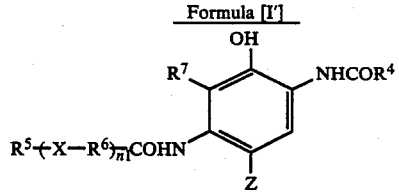

wherein $R^4$ is a phenyl group; $R^5$ is an alkyl group or an aryl group; $R^6$ is an alylene group; $R^7$ is a hydrogen atom or a halogen atom; n is 0 or a positive integer; X is —O—, —CO—, —COO—, —OCO—, —$SO_2$NR—, NR'$SO_2$—, NR''—, —S—, —SO— or —$SO_2$—, in which R' and R'' are each an alkyl group; and Z is the same as described in the formula [I].

9. The silver halide photographic light-sensitive material of claim 1, wherein said red-sensitive silver halide emulsion layers is hardened by a compound represented by the following formula [HDA] or [HDB]:

Formula [HDA]

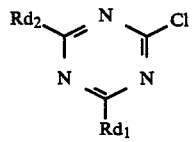

wherein $Rd_1$ is a chlorine atom, a hydroxyl group, an alkyl group, an alkylthio group, an —OM group, M being a monovalent metal atom, an —NRd'Rd'', Rd' and Rd'' being a hydrogen atom, an alkyl group or an aryl group, respectively, or an —NHCORd''' group, R''' being a hydrogen atom, an alkyl group or an aryl group; $Rd_2$ is the same as $Rd_1$ except chlorine atom;

Formula [HDB]

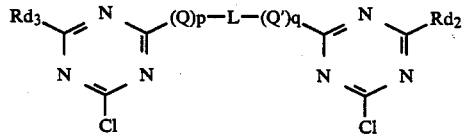

wherein $RD_3$ and $Rd_4$ are a chlorine atom, a hydroxyl group, an alkoxy group, or an —OM group, M being a monovalent metal atom, respectively; Q and Q' are a bonding group represented by a —O—, —S— or —NH—, respectively; L is an alkylene group or an arylene group and p and q are 0 or 1, respectively.

* * * * *